US008833707B2

(12) United States Patent
Steinberg et al.

(10) Patent No.: US 8,833,707 B2
(45) Date of Patent: Sep. 16, 2014

(54) DISPOSABLE UROLOGY DRAINAGE BAG

(75) Inventors: Sarah M. Steinberg, Somerville, MA (US); Paul J. Skavicus, Maynard, MA (US); Jesse S. Drake, Clinton, MA (US); Mark A. Sutherland, Sterling, MA (US); Thomas K. Skripps, Acton, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 87 days.

(21) Appl. No.: 13/177,609

(22) Filed: Jul. 7, 2011

(65) Prior Publication Data

US 2012/0014621 A1 Jan. 19, 2012

Related U.S. Application Data

(60) Provisional application No. 61/364,743, filed on Jul. 15, 2010.

(51) Int. Cl.

| | |
|---|---|
| ***A61B 19/00*** | (2006.01) |
| ***B65B 67/04*** | (2006.01) |
| ***A61G 13/10*** | (2006.01) |

(52) U.S. Cl.

CPC ..... *A61G 13/102* (2013.01); *A61G 13/101* (2013.01)

USPC ..... 248/101; 248/227.4; 248/231.51; 248/94; 5/601; 5/606; 604/357; 128/849; 128/851

(58) Field of Classification Search

CPC ..... A61B 19/087; A61B 2019/086; A61G 13/102; A61G 13/101

USPC ..... 248/231.61, 99, 101, 226.11, 227.1, 248/227.4, 228.5, 228.4, 230.4, 230.5, 248/230.6, 228.6, 231.51, 231.71, 94, 916, 248/689, 500, 694, 907; 5/601, 606, 732; 604/322, 357; 141/391; 383/33; 128/849, 851; 24/524

See application file for complete search history.

(56) References Cited

U.S. PATENT DOCUMENTS

| | | | | |
|---|---|---|---|---|
| 2,509,086 A | | 5/1950 | Eaton | |
| 2,932,873 A | * | 4/1960 | Reichert | 24/498 |
| 2,935,286 A | | 5/1960 | Parsons | |
| 2,945,731 A | * | 7/1960 | Tutrone | 5/630 |

(Continued)

FOREIGN PATENT DOCUMENTS

| | | |
|---|---|---|
| WO | WO 2005/020819 | 3/2005 |

OTHER PUBLICATIONS

European search report from related EP 11 17 4028 dated Oct. 18, 2011, 6 pages.

(Continued)

*Primary Examiner* — Anita M King

(74) *Attorney, Agent, or Firm* — Barnes & Thornburg LLP

(57) ABSTRACT

A urology drainage bag system has disposable clamps and/or bands that are disposed of along with the disposable urology drape. The drape, clamps, and band may comprise an integrated system for disposal as a unit. In some embodiments, the drape, clamps, and band are assembled together at the time of manufacture and sold as an integrated unit such that assembly of the drape onto the band by the end users at the point of use is not needed. Several plastic molded clamp embodiments are disclosed. Alternative methods and devices for supporting a flexible band and drainage bag relative to an OR table are also disclosed.

20 Claims, 20 Drawing Sheets

(56) References Cited

U.S. PATENT DOCUMENTS

| | | | | |
|---|---|---|---|---|
| 3,046,072 | A * | 7/1962 | Douglass, Jr. et al. | 5/646 |
| 3,099,441 | A | 7/1963 | Ries | |
| 3,188,079 | A | 6/1965 | Boetcker et al. | |
| 3,386,444 | A * | 6/1968 | Brenner et al. | 604/357 |
| 3,828,377 | A | 8/1974 | Fary, Sr. | |
| 3,947,686 | A | 3/1976 | Cooper et al. | |
| 4,018,412 | A | 4/1977 | Kees, Jr. et al. | |
| 4,054,282 | A | 10/1977 | Hamer | |
| 4,108,426 | A | 8/1978 | Lindstroem et al. | |
| 4,139,917 | A | 2/1979 | Fenwick | |
| 4,143,652 | A | 3/1979 | Meier et al. | |
| 4,221,371 | A | 9/1980 | Kuphal | |
| 4,225,125 | A | 9/1980 | Lee | |
| 4,355,631 | A | 10/1982 | LeVahn | |
| 4,378,794 | A | 4/1983 | Collins | |
| 4,383,351 | A | 5/1983 | Fenwick | |
| 4,414,968 | A | 11/1983 | Amin | |
| 4,474,364 | A | 10/1984 | Brendgord | |
| 4,484,911 | A | 11/1984 | Berlin et al. | |
| 4,487,523 | A | 12/1984 | Monroe | |
| 4,506,872 | A | 3/1985 | Westerberg et al. | |
| 4,526,355 | A | 7/1985 | Moore et al. | |
| 4,583,725 | A | 4/1986 | Arnold | |
| 4,671,728 | A | 6/1987 | Clark et al. | |
| 4,729,535 | A | 3/1988 | Frazier et al. | |
| 4,796,846 | A | 1/1989 | Meier et al. | |
| 4,840,363 | A | 6/1989 | McConnell | |
| 4,852,840 | A | 8/1989 | Marks | |
| 4,901,963 | A | 2/1990 | Yoder | |
| 4,901,964 | A | 2/1990 | McConnell | |
| 4,923,187 | A | 5/1990 | Mombrinie | |
| 4,971,037 | A | 11/1990 | Pelta | |
| 4,989,848 | A | 2/1991 | Monroe | |
| 5,027,832 | A | 7/1991 | Williams, Jr. | |
| 5,078,705 | A * | 1/1992 | Edwards et al. | 604/322 |
| 5,088,706 | A | 2/1992 | Jackson | |
| 5,108,213 | A | 4/1992 | Shields | |
| 5,121,892 | A | 6/1992 | Herzog | |
| 5,131,106 | A | 7/1992 | Jackson | |
| 5,135,210 | A | 8/1992 | Michelson | |
| 5,161,544 | A | 11/1992 | Morris | |
| 5,276,927 | A | 1/1994 | Day | |
| 5,279,603 | A | 1/1994 | Everett et al. | |
| 5,287,575 | A | 2/1994 | Allen et al. | |
| 5,320,444 | A | 6/1994 | Bookwalter et al. | |
| 5,326,059 | A * | 7/1994 | Pryor et al. | 248/231.71 |
| 5,388,593 | A | 2/1995 | Thomalla | |
| 5,400,772 | A | 3/1995 | LeVahn et al. | |
| 5,444,882 | A | 8/1995 | Andrews et al. | |
| 5,538,215 | A | 7/1996 | Hosey | |
| 5,581,830 | A * | 12/1996 | Schwieker | 5/606 |
| 5,613,254 | A | 3/1997 | Clayman et al. | |
| 5,658,315 | A | 8/1997 | Lamb et al. | |
| 5,701,991 | A | 12/1997 | Helmetsie | |
| 5,741,210 | A | 4/1998 | Dobrovolny | |
| 5,758,374 | A | 6/1998 | Ronci | |
| 5,836,026 | A | 11/1998 | Reed | |
| 5,836,559 | A | 11/1998 | Ronci | |
| 5,926,876 | A | 7/1999 | Haigh et al. | |
| 6,023,800 | A * | 2/2000 | Stickley | 5/621 |
| 6,120,397 | A | 9/2000 | Julian | |
| 6,260,220 | B1 | 7/2001 | Lamb et al. | |
| 6,382,576 | B1 | 5/2002 | Heimbrock | |
| 6,490,737 | B1 | 12/2002 | Mazzei et al. | |
| 6,598,275 | B1 | 7/2003 | Kolody et al. | |
| 6,622,980 | B2 | 9/2003 | Boucher et al. | |
| 6,663,055 | B2 | 12/2003 | Boucher et al. | |
| 6,691,350 | B2 | 2/2004 | Weismiller | |
| 6,754,923 | B2 | 6/2004 | Borders et al. | |
| 7,096,870 | B2 | 8/2006 | Lamprich et al. | |
| 7,096,871 | B2 | 8/2006 | Lee et al. | |
| 7,299,803 | B2 | 11/2007 | Kovac et al. | |
| 7,520,007 | B2 | 4/2009 | Skripps | |
| 7,610,918 | B2 | 11/2009 | Bowen et al. | |
| 7,690,380 | B2 | 4/2010 | Lee et al. | |
| 8,020,561 | B2 | 9/2011 | Lee et al. | |
| 2002/0061225 | A1 | 5/2002 | Boucher et al. | |
| 2004/0123389 | A1 | 7/2004 | Boucher et al. | |
| 2004/0144905 | A1 * | 7/2004 | Ropertz et al. | 248/286.1 |
| 2006/0255220 | A1 | 11/2006 | Skripps | |
| 2010/0137820 | A1 * | 6/2010 | Lee et al. | 604/322 |

OTHER PUBLICATIONS

2005 Catalog Passionate About Positioning, Allen Medical Systems, a Hill-Rom Company, (28 pages).

"Peace of Mind? Piece of Cake!, Great Products . . . Great Prices", O.R. Direct Surgical Table Accessories, Fall 1999, (24 pages).

"Passionate About Positioning", Allen Medical Systems ,(20 pages), 1999.

* cited by examiner

DISPOSABLE UROLOGY DRAINAGE BAG

CROSS REFERENCE TO RELATED APPLICATIONS

The present application claims the benefit, under 35 U.S.C. §119(e), of U.S. Provisional Application No. 61/364,743 which was filed Jul. 15, 2010 and which is hereby incorporated by reference herein.

BACKGROUND

The present disclosure relates to disposable urology drainage bags and particularly, to urology drainage bags that attach to surgical tables. More particularly, the present disclosure relates, in large part, to urology drainage bag systems having devices that clamp onto the accessory rails of surgical tables.

Urology drainage bags that collect fluids during urological procedures are known. For example, Allen Medical Systems, Inc. markets the URO CATCHER® system, model number O-UC4 that can be used with URO CATCHER drapes, model numbers 0-UC31 and O-UC32, and with Brachytherapy drapes, model numbers A-50007 and A-50008. While the drapes are disposable, the URO CATCHER® system includes reusable accessory rail clamps and a flexible band that interconnects the clamps. Before re-use, the clamps and band are cleaned and may be sterilized. Furthermore, when not in use, the clamps and bands of the prior art URO CATCHER® system need to be stored somewhere.

SUMMARY

According to this disclosure, a urology drainage bag system has disposable clamps and/or bands that are disposed of along with the disposable urology drape. The drape, clamps, and band may comprise an integrated system for disposal as a unit. In some embodiments, the drape, clamps, and band are assembled together at the time of manufacture and sold as an integrated unit such that assembly of the drape onto the band by the end users at the point of use is not needed.

A disposable drainage bag system may include a drainage bag, a band coupled to and supporting the drainage bag, and a rail clamp. The rail clamp may include an upper jaw configured to engage the accessory rail of the surgical table and a slot sized to receive the band.

In some embodiments, the rail clamp may also include a protrusion extending into the slot. The band may be formed to include a hole extending through the band and configured to receive the protrusion when the band is received in a predetermined position in the slot.

The clamp may include a lower platform formed to include a threaded hole and a threaded knob engaging the threaded hole. The clamp may include a protrusion extending into the slot. The lower platform, the upper jaw, and the protrusion may form a monolithic clamp body. In some embodiments, the clamp may include a lever and the protrusion may extend out from the lever. The lever may be movable between a locked position wherein the protrusion extends through the band blocking the band from being removed from the slot and a released position wherein the protrusion is moved out of the slot so that the band can be removed from the slot. The clamp may also include a lower jaw movable relative to the upper jaw to clamp the accessory rail between the upper jaw and the lower jaw.

In some embodiments, the lower jaw may be moved between the open position and the closed position by the threaded knob. The lower jaw may pivot about a jaw axis to move between the open and the closed position.

The upper jaw, the lower platform, and the lower jaw may cooperate to form a monolithic clamp body. The clamp body may include a living hinge defining a jaw axis about which the lower jaw pivots. The clamp body may be formed from a plastics material.

In some embodiments, a clamp for coupling a drainage bag and a band to a surgical table having an accessory rail is disclosed. The clamp may include a beam, an upper jaw extending from the beam, a lower platform extending from the beam and formed to include a threaded hole, and a threaded knob. The threaded knob may engage the threaded hole of the lower platform. The knob may be rotatable to advance an end of the threaded knob toward the upper jaw and to clamp the upper jaw against the accessory rail.

The clamp may be formed to include a slot extending through the clamp and sized to receive the band. The clamp may include a protrusion extending into the slot and configured to locate the band at a predetermined position when the band is received in the slot. In some embodiments, the protrusion may be selectively pivotable out of the slot. The beam, the upper jaw, the lower platform, and the protrusion may form a monolithic clamp body.

The clamp may include a lower jaw and a rail opening may extend between the upper jaw and the lower jaw. The lower jaw may be pivotable about a jaw axis defined by a living hinge.

It is also contemplated that a clamp for coupling a drainage bag to a surgical table having an accessory rail may include a beam, an upper jaw extending from the beam, a lower jaw connected to the beam by a living hinge. The beam, the upper jaw, and the lower jaw may be formed as a monolithic clamp body. The lower jaw may be moved relative to the beam to clamp the accessory rail between the upper and lower jaw.

In some embodiments, the clamp may also include a threaded knob configured to move the lower jaw from the open position to the closed position. The monolithic clamp body may include a lower platform formed to include a threaded hole sized to receive the threaded knob In many of the disclosed embodiments, it is contemplated that the clamps are molded from a plastics material. Some of the clamp embodiments have living hinges that permit clamp portions to fold around the accessory rails of surgical tables. Some of the clamp embodiments have separate plastic pieces that attach together to encompass some or all of the accessory rails. Some of the clamp embodiments have a first piece with a serrated or barbed protrusion, for example, that extends into a hole, recess, pocket or cavity of a second piece to attach the first and second clamp pieces together. Alternative methods and devices for supporting a flexible band and drainage bag relative to an OR table are also disclosed.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
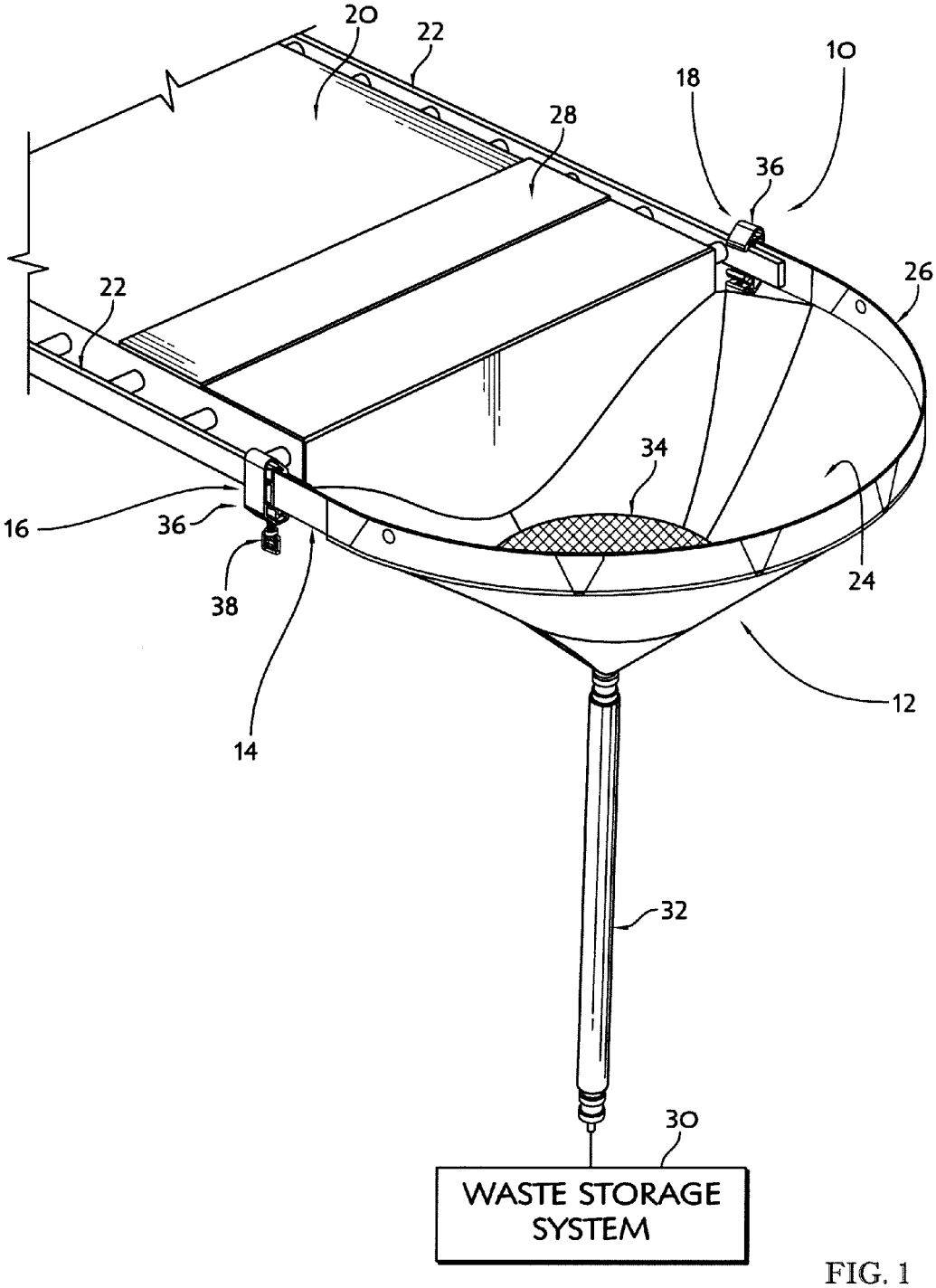
FIG. 1 is a perspective view showing a disposable drainage bag system coupled to accessory rails of a surgical table by two clamps.
Figure 2:
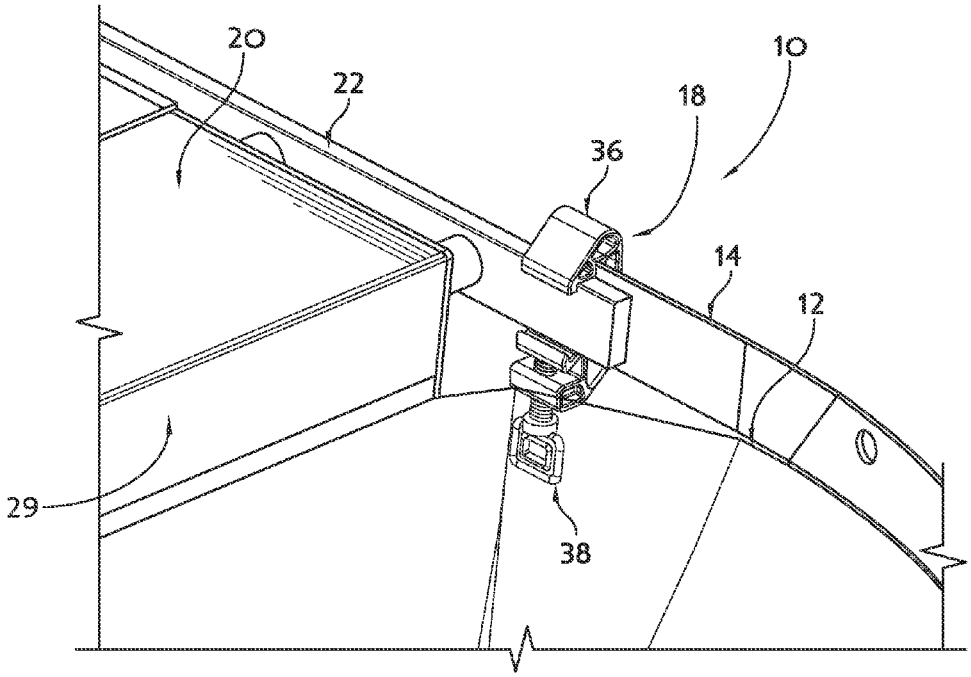
FIG. 2 is a detail perspective view of the disposable drainage bag system of FIG. 1 showing one of the clamps engaged with one of the accessory rails to hold the drainage bag system in place relative to the surgical table.

An illustrative disposable urology drainage bag system 10 includes a drainage bag 12, a flexible support band 14, a first clamp 16, and a second clamp 18 as shown in FIG. 1. Drainage bag system 10 is configured to be used with a surgical table 20 having accessory rails 22. Drainage bag 12 is supported and held open by flexible support band 14 during surgery. Flexible support band 14 supports drainage bag 12 as shown, for example, in FIG. 1. Clamps 16, 18 are coupled to flexible support band 14 and clamps 16, 18 clamp on to accessory rails 22 of surgical table 20 to couple drainage bag system 10 to surgical table 20 during surgery.

Illustratively, drainage bag 12 is constructed from a flexible sheet of plastics material. Drainage bag 12 includes a reservoir portion 24, a sleeve portion 26, and a flap 28 as shown in FIG. 1. Reservoir portion 24 is situated near and contacts an edge 29 of surgical table 20 as shown in FIG. 1. Sleeve portion 26 wraps around flexible support band 14 and couples drainage bag 12 to flexible support band 14. Flap 28 extends over surgical table 20 so that fluids are blocked from contact with surgical table 20.

Flexible support band 14 is operable to support and to hold open reservoir portion 24 of drainage bag 12 as shown in FIG. 1. Flexible support band 14 is flexible in the horizontal direction and is semi-rigid in the vertical direction. On account of its flexibility in the horizontal direction, flexible support band 14 is operable to flex in response to a surgeon or other caregiver contacting flexible support band 14 so that the surgeon or caregiver is not blocked from approaching the surgical table 20 by the drainage bag system 10. Flexible support band 14 is illustratively made from a disposable or recyclable plastics material. However, in other embodiments, flexible support band 14 may be made from other materials.

Reservoir portion 24 of drainage bag 12 collects and directs fluids toward a waste storage system 30. Reservoir portion 24 is coupled to waste storage system 30 by a tube 32. In the illustrative embodiment, a mesh screen 34 is situated in reservoir portion 24 to block solid waste, dropped tools, or other non-liquid items from being directed to waste storage system 30. In other embodiments, no mesh screen is used.

Figure 3:
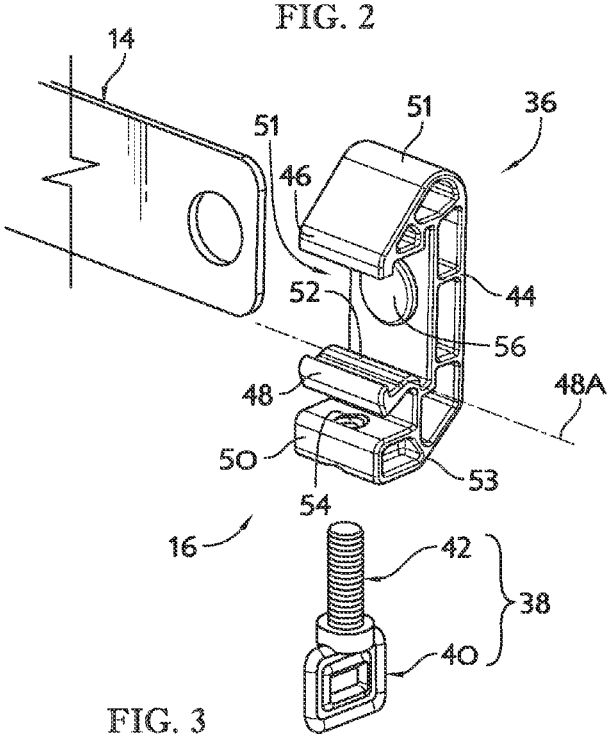
FIG. 3 is a detail exploded view of the clamp of FIGS. 1 and 2 and of a flexible band used to support a drainage bag showing that the clamp includes a clamp body and a threaded knob.

Clamps 16, 18 are substantially similar and the following description of clamp 16 applies to clamp 18. Clamp 16 includes a clamp body 36 and a threaded knob 38 as shown in FIG. 3. Illustratively, clamp body 36 is monolithically formed from a plastics material that is readily disposable or recyclable. Threaded knob 38 includes a head 40 and a threaded portion 42 as shown, for example, in FIG. 3. Threaded knob 38 is illustratively constructed from a plastics material that is readily disposable or recyclable.

Figure 4:
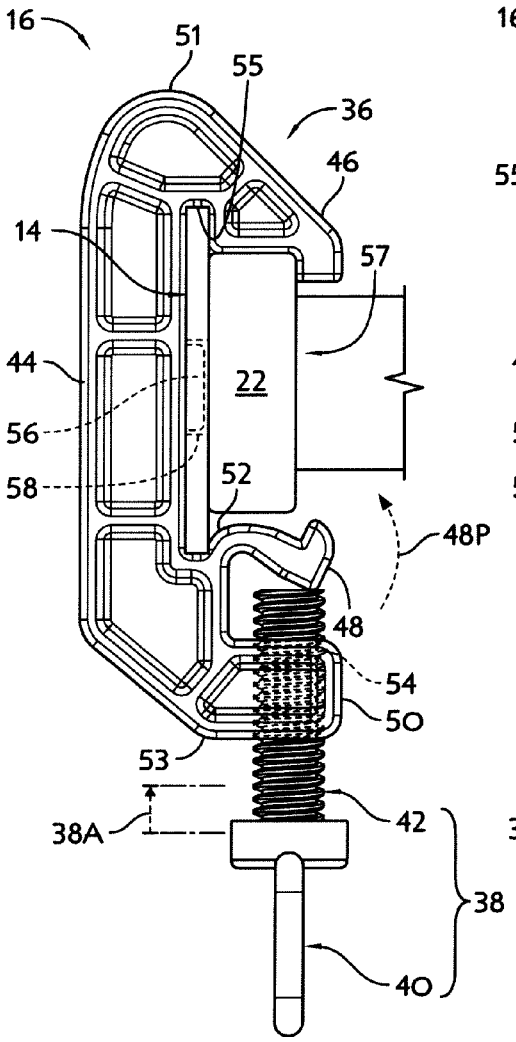
FIG. 4 is a side elevation view of the clamp of FIGS. 1-3 shown in an open position wherein a lower jaw of the clamp body is spaced from the accessory rail so that the clamp can slide along the accessory rail.

Clamp body 36 is illustratively formed to include a beam 44, an upper jaw 46, a lower jaw 48, and a lower platform 50 as shown in FIG. 4. Upper jaw 46 extends from a top end 51 of beam 44. Lower jaw 48 is coupled to beam 44 by a living hinge 52 defining a jaw axis 48A shown in FIG. 3. Lower platform 50 extends from a bottom end 53 of beam 44 and is formed to include a threaded hole 54 sized to engage with the threaded portion 42 of threaded knob 38. Lower jaw 48 is situated between upper jaw 46 and lower platform 50 and an opening 57 is formed between upper jaw 46 and lower jaw 48 to receive accessory rail 22 as shown in FIGS. 4 and 5.

Figure 5:
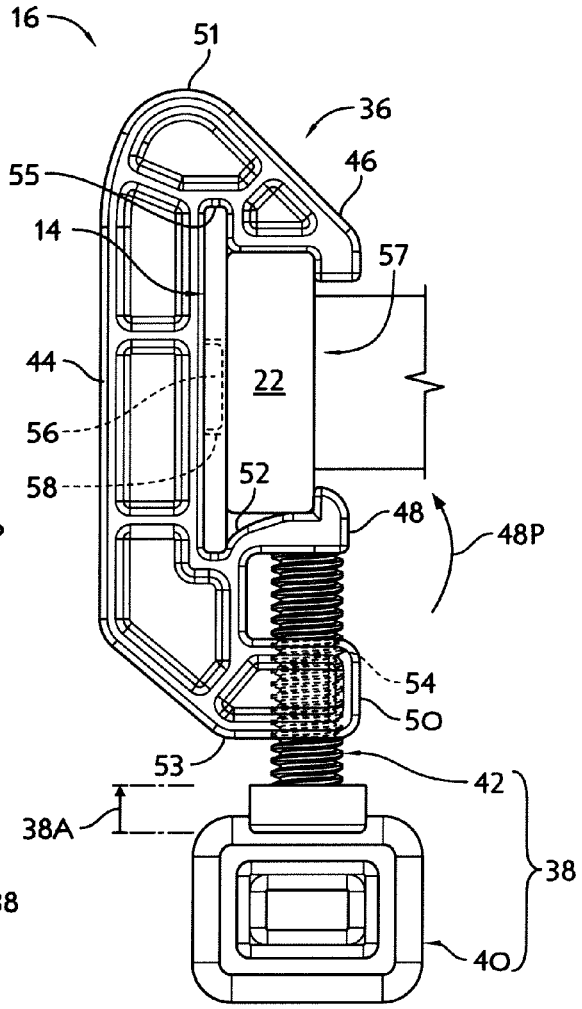
FIG. 5 is a side elevation view of the clamp of FIG. 4 shown in a closed position wherein a lower jaw of the clamp body is pivoted about a living hinge formed by the clamp body so that the lower jaw and the upper jaw are clamped on to the accessory rail.

Lower jaw 48 of clamp body 36 moves between an open position, shown in FIG. 4, and a closed position shown in FIG. 5. When lower jaw 48 is in the open position, clamp 16 is free to slide on to and along accessory rail 22. When lower jaw 48 is in the closed position, upper and lower jaws 46, 48 are clamped on to accessory rail 22 as shown in FIG. 5. Lower jaw 48 is biased toward the open position by living hinge 52 as suggested in FIG. 4. To move lower jaw 48 from the open position to the closed position, a user rotates threaded knob 38 so that threaded knob 38 moves through lower platform 50 toward upper jaw 46 as suggested by arrow 38A in FIGS. 4 and 5. Threaded knob 38 engages lower jaw 48 as it moves toward upper jaw 46 and causes lower jaw 48 to pivot about jaw axis 48A as suggested by arrow 48P shown in FIGS. 4 and 5. To move lower jaw 46 from the closed position to the open position, a user rotates the threaded knob 38 to move threaded knob 38 away from upper jaw 46. When threaded knob 38 is moved away from upper jaw 46, lower jaw 48 moves away from upper jaw 46.

Beam 44 of clamp body 36 is formed to include a slot 55 and a protrusion 56 as shown, for example, in FIG. 3. Slot 55 is sized to receive flexible support band 14. In the illustrative embodiment of FIGS. 1-5, slot 55 is in communication with opening 57 configured to receive accessory rail 22. In other embodiments, slot 55 may be independent from opening 57. Protrusion 56 is configured to be received in a hole 58 formed in flexible support band 14 to locate flexible support band 14 in clamp 16 when flexible support band 14 is received in slot 55.

Figure 6:
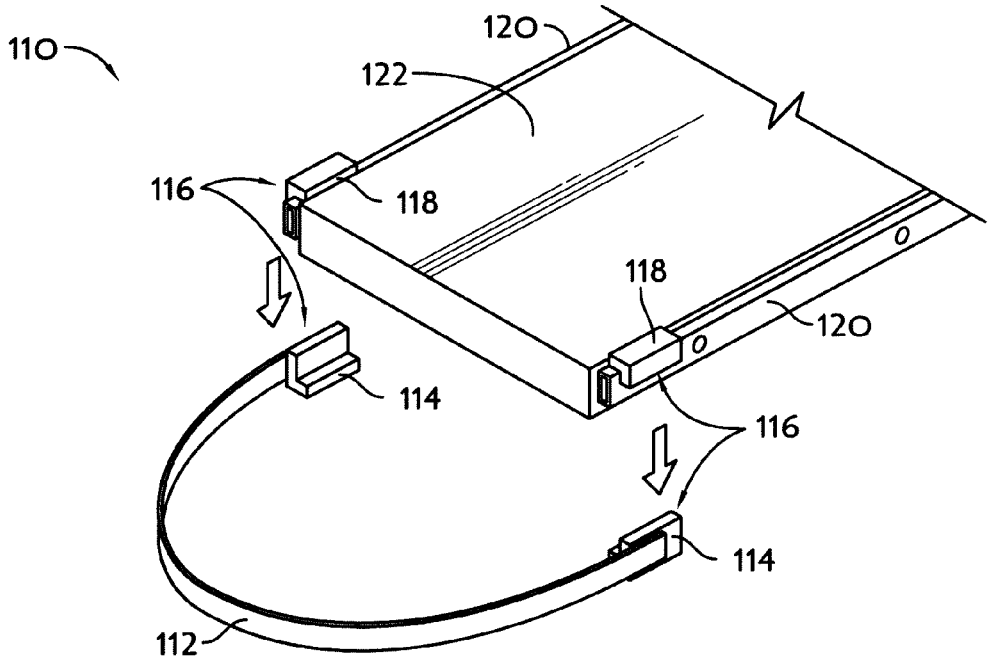
FIG. 6 is a perspective view showing an embodiment in which a flexible band is secured to lower sections of a pair of rail clamps, upper and lower portions of the pair of rail clamps being separable into two pieces, and the band being removed along with the lower section of the rail clamps.
Figure 7:
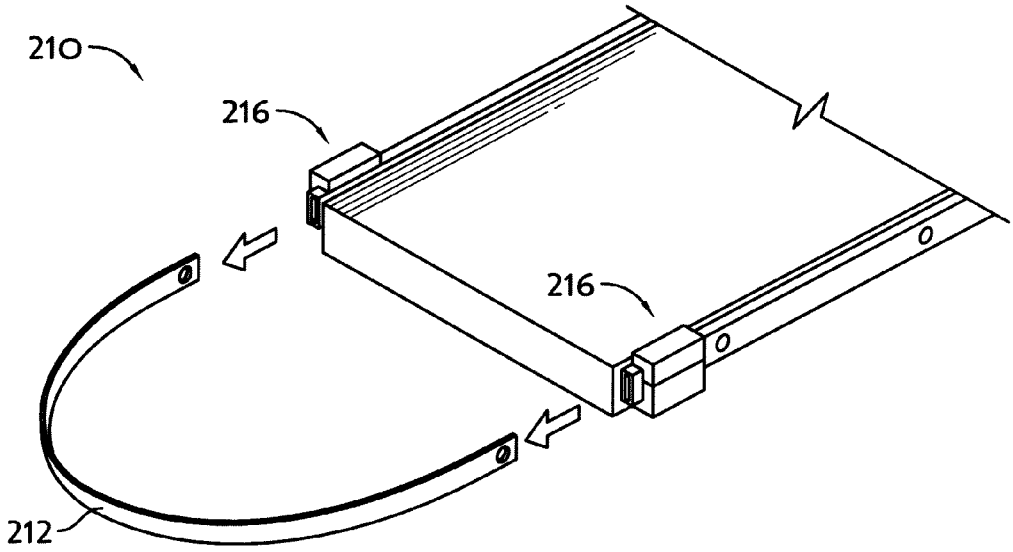
FIG. 7 is a perspective view, similar to FIG. 1, showing an embodiment in which the flexible band is detachable from the rail clamps.

Another embodiment 110 is shown in FIG. 6 in which a flexible band 112 is secured to lower sections or portions 114 of a pair of rail clamps 116 which also have an upper section or portion 118. The upper and lower portions 114, 118 of the pair of rail clamps 116 are separable into two pieces that selectively attach to one another that detach from one another. In the illustrative example, band 112 is removed along with the lower section 114 of the rail clamps. Clamps 116 attach to accessory rails 120 of an OR table or surgical table 122. An embodiment 210 in which a flexible band 212 is detachable from associated rail clamps 216 is shown in FIG. 7.

Figure 8:
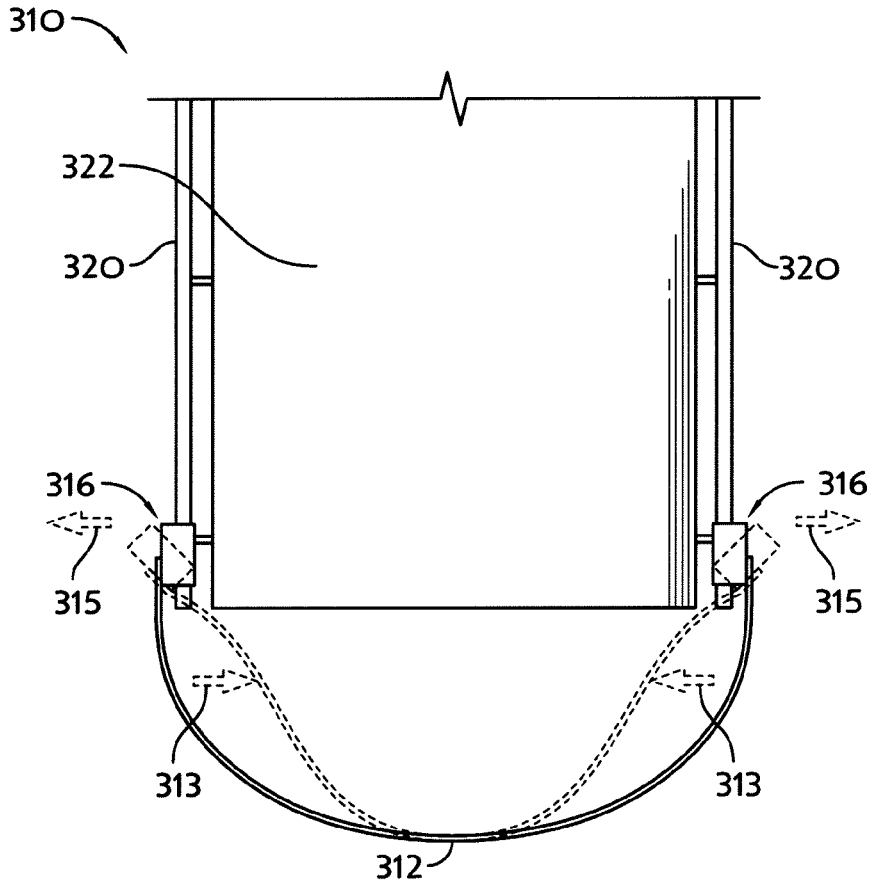
FIG. 8 is a top plan view showing a flexible band having its opposite ends integrated with a respective clamp of a pair of rail clamps with the clamps being mounted to accessory rails of a surgical table.

A flexible band 312 has its opposite ends integrated with a respective clamp 316 of a pair of rail clamps 316 as shown in the embodiment 310 of FIG. 8. The clamps 316 are mounted to accessory rails 320 of a surgical table 322. In this example, the flexible band 312 has side portions that are squeezed or flexed inwardly toward another in the direction of arrows 313 to snap the clamps 316 off of the accessory rails 320 in the directions of arrows 315.

Figure 9:
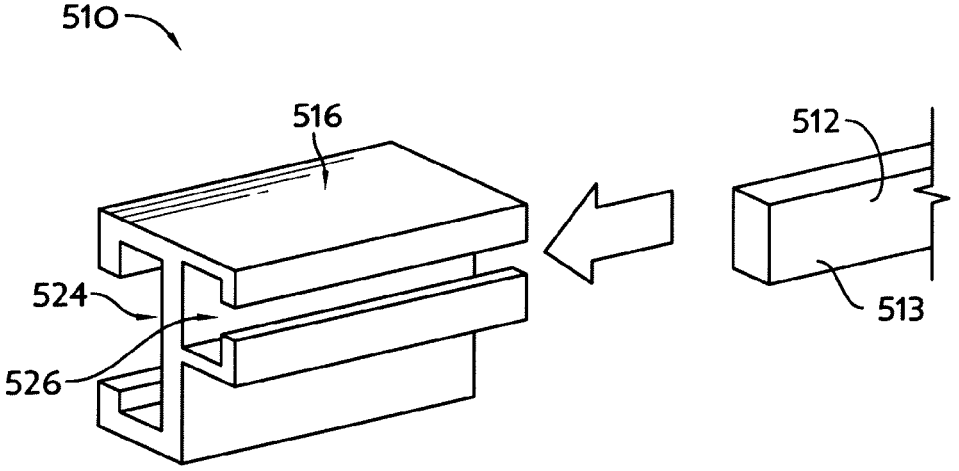
FIG. 9 is a perspective view showing an embodiment in which a rail clamp has a larger, first channel sized to receive an accessory rail of a surgical table and a smaller, second channel sized to receive an end of a flexible band and showing an end of a flexible band arranged for insertion into the second channel.
Figure 10:
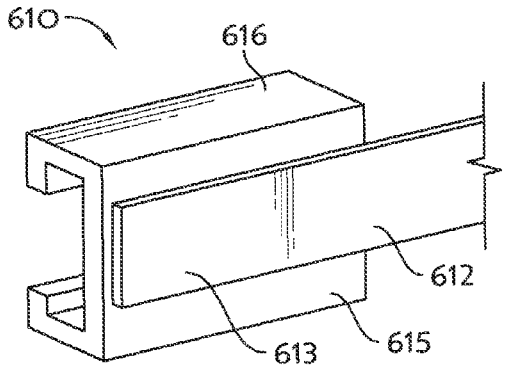
FIG. 10 is a perspective view showing an embodiment in which a flexible band is adhered to a rail clamp via heat or adhesive material.

An embodiment 510 in which a rail clamp 516 has a larger, first channel 524 sized to receive an accessory rail (not shown in FIG. 9) of a surgical table and a smaller, second channel 526 sized to receive an end of a flexible band 512 is shown in FIG. 9. An end 513 of flexible band 512 is arranged for insertion into the second channel 526. The end 513 is held in channel 526 by an interference fit in some embodiments. In other embodiments, end 513 is adhered to clamp 516 such as by heat (e.g., RF or sonic welding) or by using an adhesive material (e.g., glue or cement). In an alternative embodiment 610, shown in FIG. 10, an end 613 of a flexible band 612 is adhered to a vertical wall 615 of a rail clamp 616 via heat or adhesive material. Thus, clamp 616 of FIG. 10 is similar to clamp 516 of FIG. 9 except that the structure of the clamp 516 forming channel 526 is omitted in clamp 616.

Figure 11:
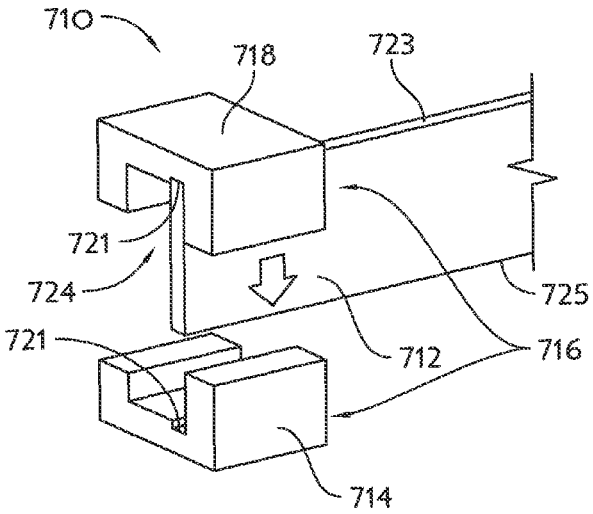
FIG. 11 is a perspective view showing an embodiment in which two clamp halves having grooves that receive upper and lower edge regions of the flexible band with the flexible band situated in the same channel of the accessory rail clamp that receives an accessory rail of a surgical table such that a portion of the flexible band will be adjacent the accessory rail.

Referring now to FIG. 11, an embodiment 710 of a rail clamp 716 has two clamp halves 714, 718 each of which has a groove 721 that receives upper and lower edge regions 723, 725 of a flexible band 712 with the flexible band situated in the same channel 724 of the accessory rail clamp 716 that receives an accessory rail (not shown in FIG. 11) of a surgical table (not shown in FIG. 11) such that a portion of the flexible band 712 will be adjacent the accessory rail.

Figure 12:
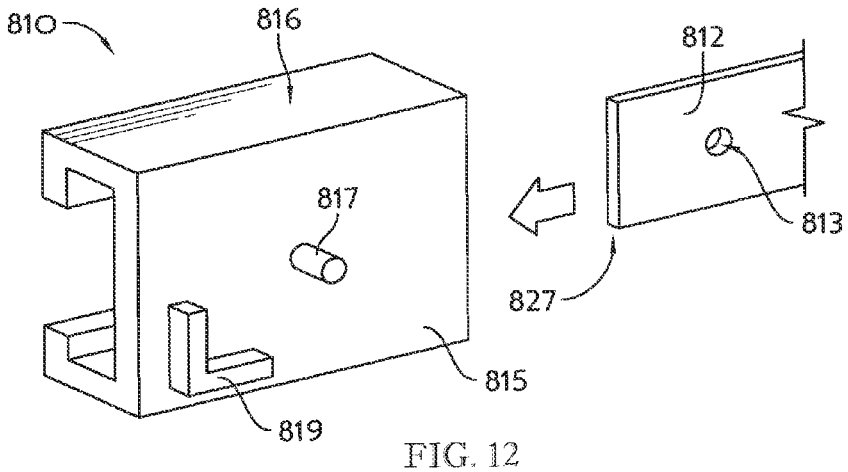
FIG. 12 is a perspective view showing an embodiment in which an end region of a flexible band has a through hole, a rail clamp has a post protruding from a vertical wall of a rail clamp, and the rail clamp also has an L-shaped corner locator protruding from the vertical wall.
Figure 13A:
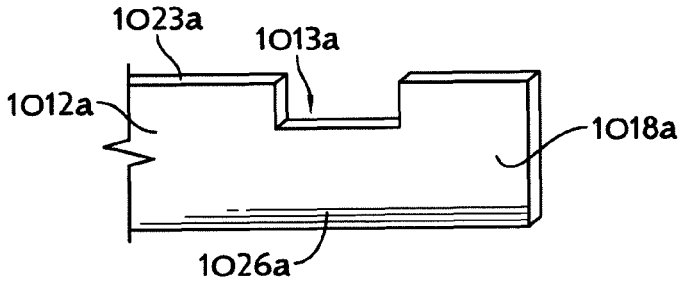
FIG. 13 has five views, labeled A-E, showing an end region of five different flexible bands each having a different tab shape.
Figure 13B:
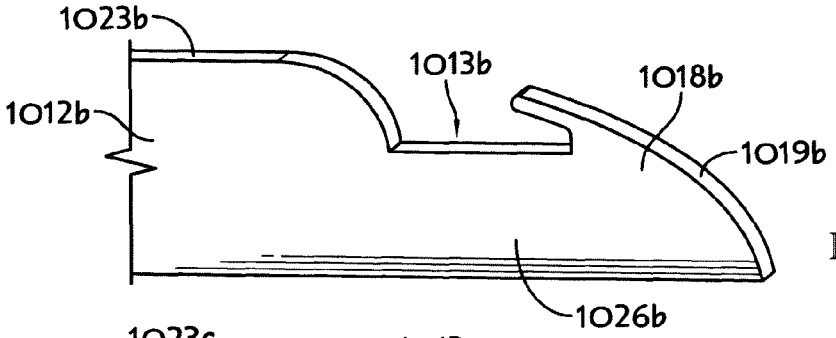
Figure 13C:
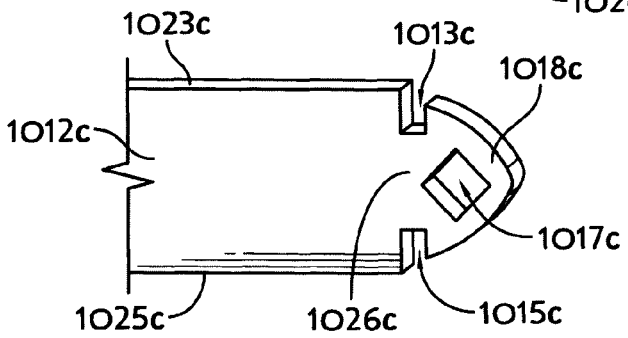
Figure 13D:
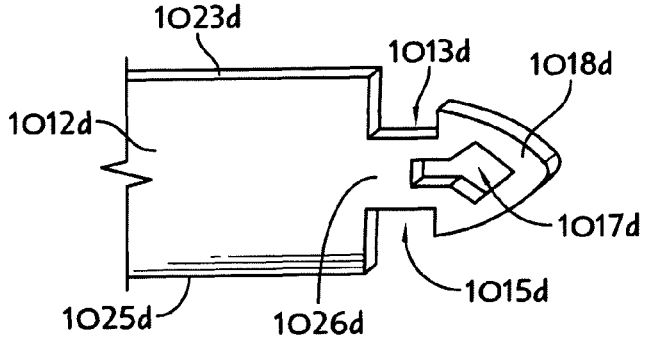
Figure 13E:
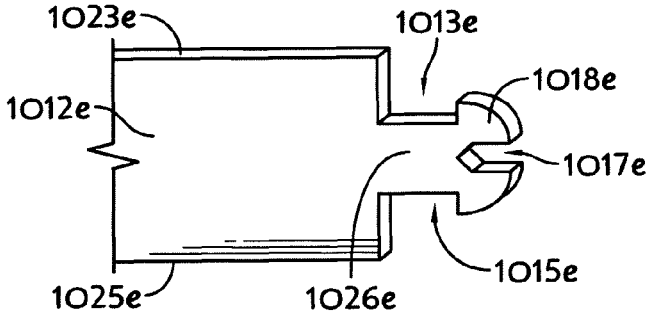
Figure 14A:
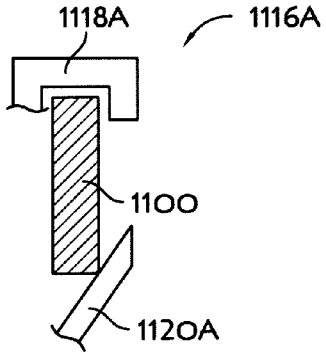
FIG. 14 has twelve views, labeled A-L, showing cross sections of different rail clamps contemplated by this disclosure with each of the different rail clamps being attachable to a standard-sized accessory rail of a surgical table.
Figure 14B:
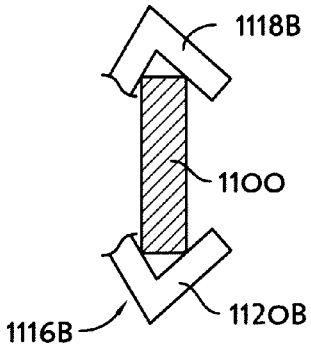
Figure 14C:
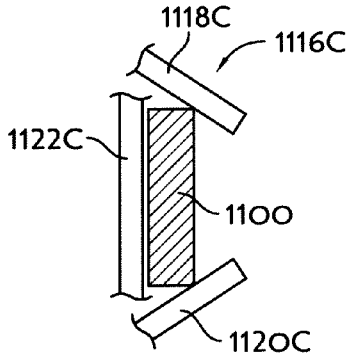
Figure 14D:
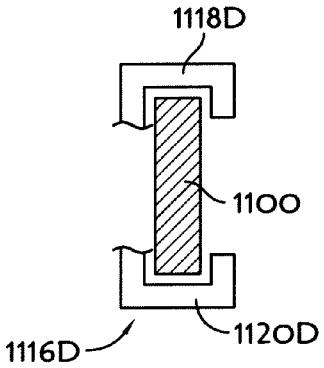
Figure 14E:
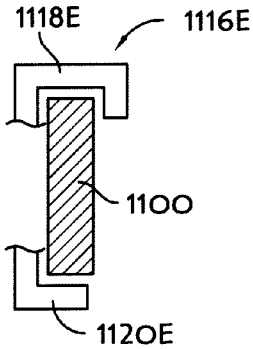
Figure 14F:
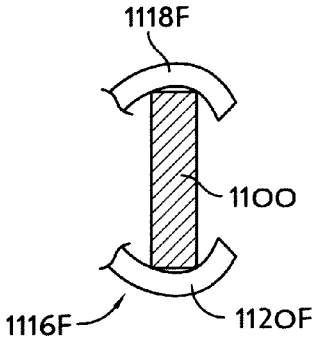
Figure 14G:
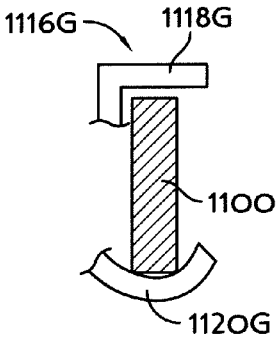
Figure 14H:
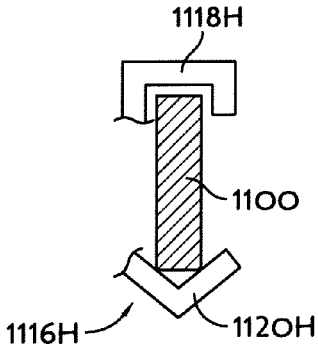
Figure 14I:
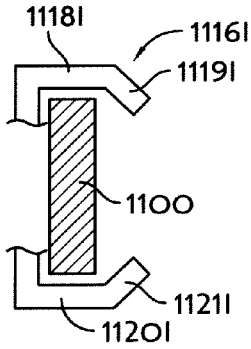
Figure 14J:
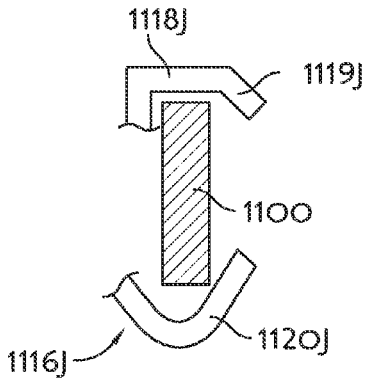
Figure 14K:
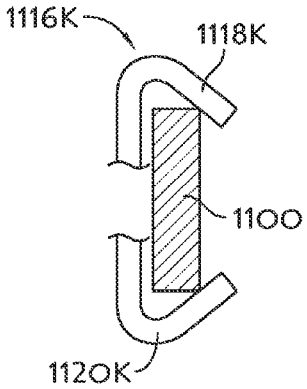
Figure 14L:
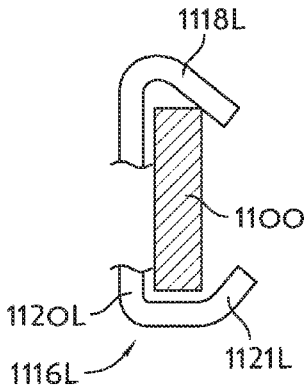

Referring now to FIG. 12, an embodiment 810 includes a flexible band 812 having a through hole 813 and a rail clamp 816 having a post 817 protruding from a vertical wall 815 of rail clamp 816. Rail clamp 816 also has an L-shaped corner locator 819 protruding from the vertical wall 815. A corner 827 of band 812 nests within the corner locator 819 and post 817 is received in hole 813 when band 812 is attached to clamp 816. In some embodiments, post 817 has a slightly enlarged head that snaps through hole 813 when band 812 is being attached to clamp 816 or detached from clamp 816. In other embodiments, the end of post 817 may be staked or headed to enlarge the end of post 817 by a sufficient amount after band 812 has been attached to permanently attach band 812 to clamp 816.

FIG. 13 has five views, labeled A-E, showing an end region of five different flexible bands 1012*a*-1012*e* each having a different tab shape. The topmost view with will be referred to as the first view of FIG. 13 and the bottommost view will be referred to as the fifth view of FIG. 13 with similar numerical designators from top to bottom of FIG. 13. In the first view of FIG. 13, band 1012*a* has a notch 1013*a* along its top edge 1023*a* such that a generally square-shaped tab portion 1018*a* of band 1012*a* is defined next to a necked down portion 1026*a* of band 1012*a*. In the second view of FIG. 13, band 1012*b* has an undercut notch 1013*b* along its top edge 1023*b* such that a barbed tab portion 1018*b* of band 1012*b* is defined next to a necked down portion 1026*b* of band 1012*b*. Barbed tab portion 1018*b* has an arcuate upper edge 1019*b*. In the third view of FIG. 13, band 1012*c* is substantially similar to band 412 of FIG. 4 and has a rounded tab 1018*c* next to a necked down portion 1026*c*. Notches 1013*c* and 1015*c* are provided in an upper edge 1023*c* and bottom edge 1025*c* of band 1012*c* to define necked down portion 1026*c*. Tab 1018*c* has a diamond shaped opening 1017*c*.

In the fourth view of FIG. 13, band 1012*d* has a spade shaped tab 1018*d* next to a necked down portion 1026*d*. Notches 1013*d* and 1015*d* are provided in an upper edge 1023*d* and bottom edge 1025*d* of band 1012*d* to define necked down portion 1026*d*. Tab 1018*d* has a somewhat diamond shaped opening 1017*d*. In the fifth view of FIG. 13, band 1012*e* has a rounded tab 1018*e* next to a necked down portion 1026*e*. Notches 1013*e* and 1015*e* are provided in an upper edge 1023*e* and bottom edge 1025*e* to define necked down portion 1026*e*. Tab 1018*e* has a horizontal slot 1017*e* provided along a longitudinal centerline of band 1012*e*.

FIG. 14 has twelve views, labeled A-L, showing cross sections of different rail clamps 1116A-1116L contemplated by this disclosure with each of the different rail clamps being attachable to a standard-sized accessory rail 1100 of a surgical table. Clamp 1116A has an upside down U-shaped upper jaw portion 1118A and an upwardly inclined lower jaw portion 1120A. Clamp 1116B has an upside down V-shaped upper jaw portion 1118B and a V-shaped lower jaw portion 1120B. Clamp 1116C has a downwardly inclined upper jaw portion 1118C, an upwardly inclined lower jaw portion 1120C, and a straight vertical wall 1122C. Clamp 1116D has an upside down U-shaped upper jaw portion 1118D and U-shaped lower jaw portion 1120D. Clamp 1116E has an upside down U-shaped upper jaw portion 1118E and an L-shaped lower jaw portion 1120E.

Clamp 1116F has a downwardly arced upper jaw portion 1118F and an upwardly arced lower jaw portion 1120F. Clamp 1116G has an upside down L-shaped upper jaw portion 1118G and an upwardly arced lower jaw portion 1120G. Clamp 1116H has an upside down U-shaped upper jaw portion 1118H and a V-shaped lower jaw portion 1120H. Clamp 1116I has an upside down L-shaped upper jaw portion 1118I with a downwardly inclined lip extension 1119I and an L-shaped lower jaw portion 1120I with an upwardly inclined lip extension 1121I. Clamp 1116J has an upside down L-shaped upper jaw portion 1118J with a downwardly inclined lip extension 1119J and a V-shaped lower jaw portion 1120J. Clamp 1116K has a tilted upside down V-shaped upper jaw portion 1118K and a tilted V-shaped lower jaw portion 1120K. Clamp 1116L has an upside down tilted V-shaped upper jaw portion 1118L and an L-shaped lower jaw portion 1120L with an upwardly inclined lip extension 1121L.

Figure 15A:
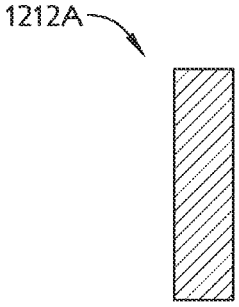
FIG. 15 has two views, labeled A and B, showing cross sections of different flexible bands contemplated by this disclosure.
Figure 15B:
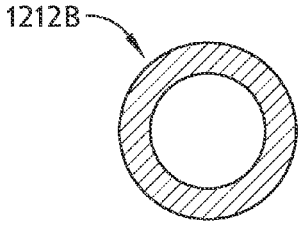

FIG. 15 has two views, labeled A and B, showing cross sections of different flexible bands 1212A and 1212B contemplated by this disclosure. Band 1212A has an upright solid rectangular cross section. Band 1212B has an upright hollow rectangular cross section.

Figure 16:
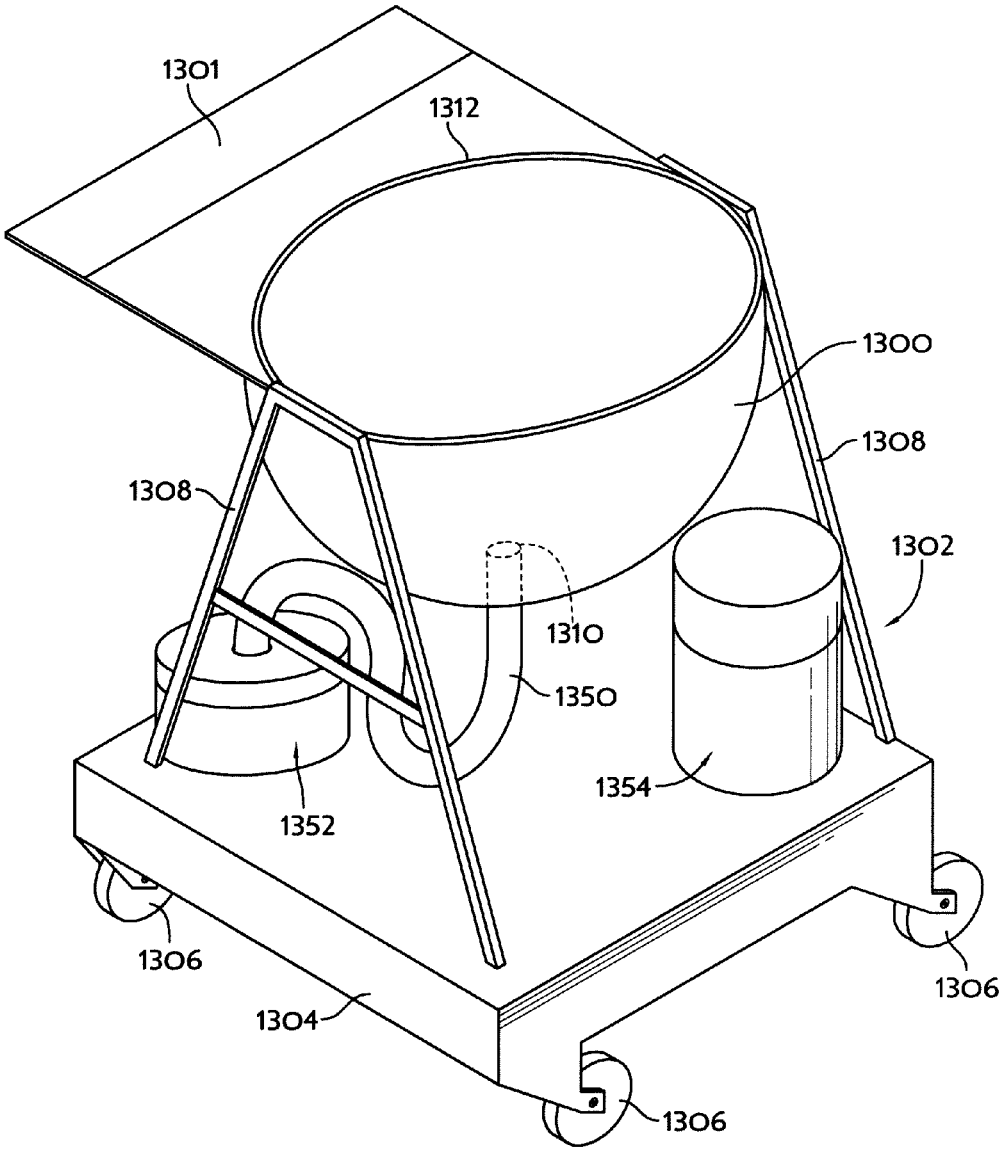
FIG. 16 is a perspective view showing a urology drainage bag attached to a roll-away cart that can be used in the place of a urology bag that is attached to an OR table with the urology bag having an integrated flexible band at its upper opening.

Referring now to FIG. 16, a urology drainage bag 1300 is attached to a roll-away cart 1302. Bag 1300 and cart 1302 can be used in the place of a urology bag that is attached to an OR table. The cart 1302 has a base 1304 supported on a set of corner casters 1306. Cart 1302 has a pair of upright A-frames 1308 extending upwardly from base 1304 on opposite side of cart 1302. Urology bag 1300 has an integrated flexible band 1312 at its upper opening. Bag 1300 also includes a flap 1301 extending out from band 1312 and configured to overlie an end region of an OR table or table mattress (not shown). Portions of band 1312 attach to the upper ends of A-frames 1308. A drainage hose 1350 extends from a bottom of bag 1300 to a fluid collection canister 1352 that is supported by base 1304. Fluid collected in bag 1300 during surgery drains into hose 1350 through a bottom opening 1310 of bag 1300 A trash receptacle 1354 is also supported by base 1304.

Figure 17:
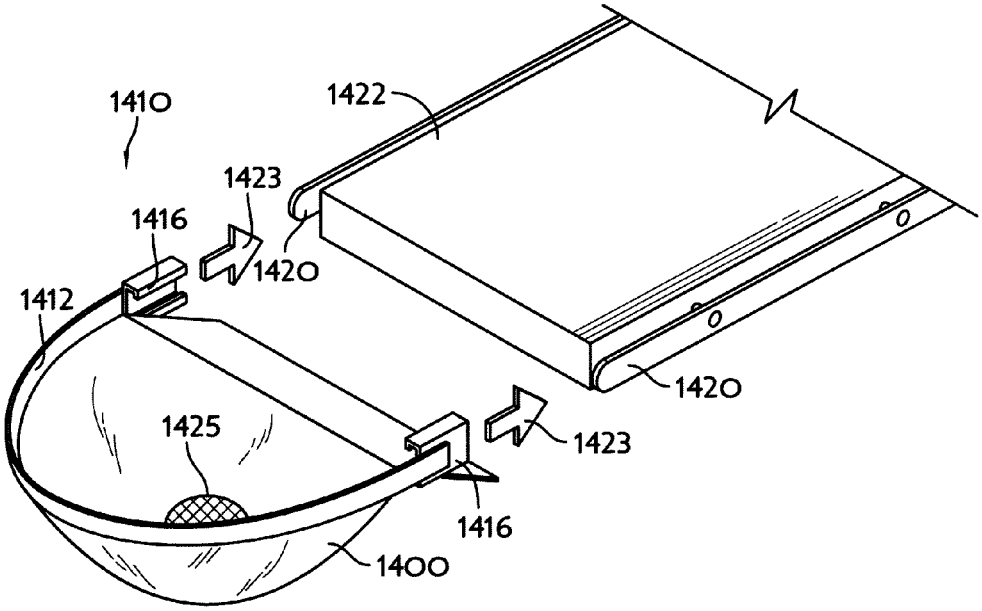
FIG. 17 is a perspective view showing an embodiment having integrated clamps, flexible band, and urology drainage bag arranged for attachment to a pair of accessory rails at the end of an OR table in the direction of the pair of double arrows.
Figure 18:
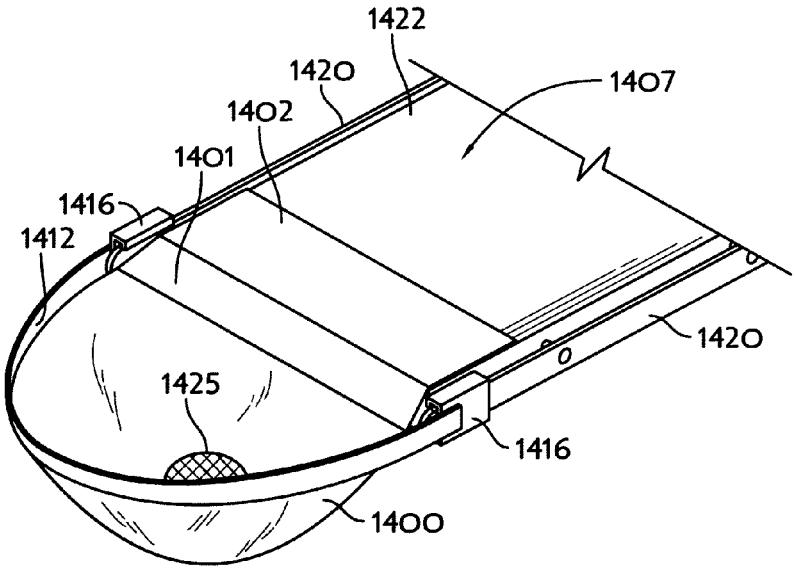
FIG. 18 is a perspective view, similar to FIG. 14, with the integrated clamps, band, and bag attached to the accessory rails of the OR table and a flap of the drainage bag moved to a position overlying an end region of an OR table mattress.

Referring now to FIG. 17, an embodiment 1410 has integrated clamps 1416, flexible band 1412, and urology drainage bag 1400 arranged for attachment to a pair of accessory rails 1420 at the end of an OR table 1422 in the direction of the pair of double arrows 1423. A mesh screen 1425 is positioned in drainage bag 1400 to block non-liquids from exiting drainage bag 1400. The integrated clamps 1416, band 1412, and bag 1400 are attached to the accessory rails 1420 of the OR table 1422 in FIG. 18. Also in FIG. 18, a flap 1402 of the drainage bag 1400 is shown moved to a position overlying an end region of an OR table mattress 1407 with a transition region 1401 of drainage bag 1400 interconnecting the flap 1402 and main bag portion of bag 1400.

Figure 19:
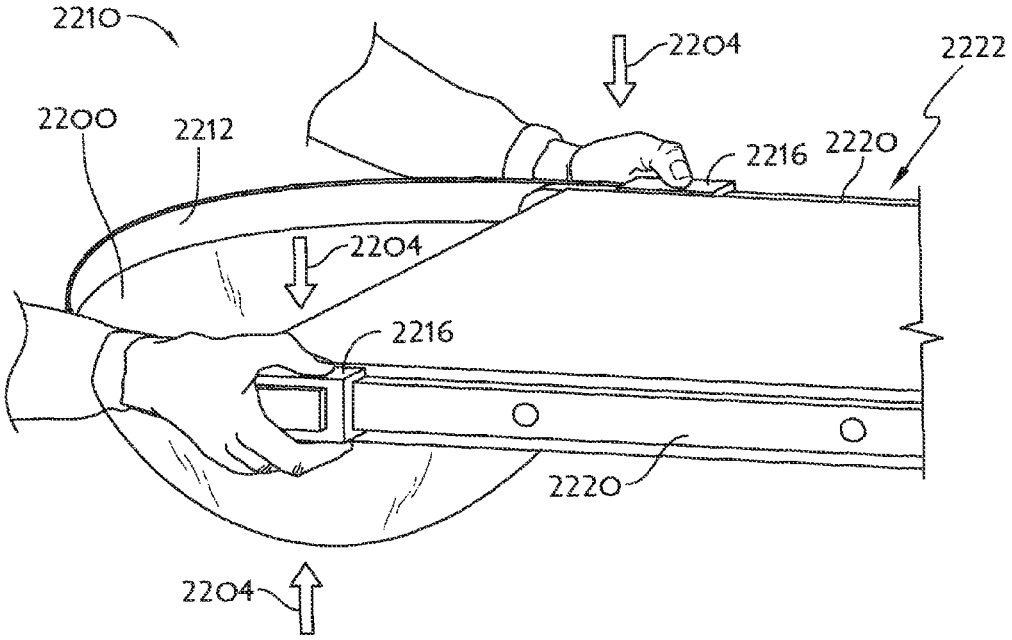
FIG. 19 is a perspective view showing a user's hands holding rail clamps of an integrated system attached to accessory rails of an OR table and showing a set of double arrows which diagrammatically indicate a squeezing motion by the user's hands to secure the rail clamps to the accessory rails.

Referring now to FIG. 19, a user's hands are holding rail clamps 2216 of an integrated clamp 2216, band 2212, and drainage bag 2200 system 2210 in a position for generally simultaneous attachment of the clamps 2216 of the integrated system 2210 to accessory rails 2220 of an OR table 2222. After attaching system 2210 to rails 2220, the rail clamps 2216 of the integrated system 2210 are squeezed in the direction of arrows 2204 to secure the rail clamps 2216 to the accessory rails 2220.

Figure 20:
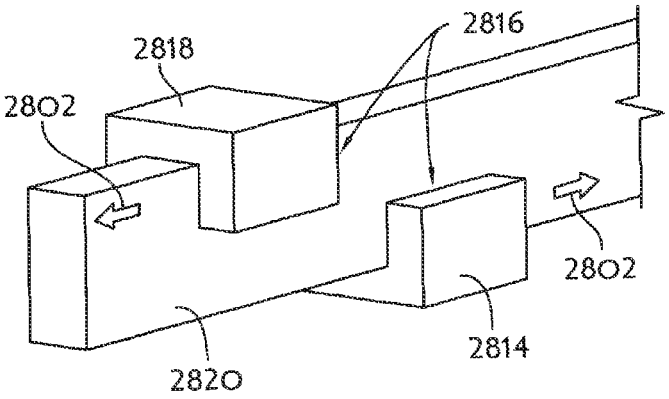
FIG. 20 is a perspective view showing a manner of removing a rail clamp from the accessory rail by sliding upper and lower rail clamp portions horizontally in opposite directions along the accessory rail to achieve separation of the rail clamp portions for removal.

FIG. 20 illustrates the general concept of removing a rail clamp 2816 from an accessory rail 2820 by sliding lower and upper rail clamp 2814, 2818 portions horizontally in opposite directions, indicated by arrows 2802, along the accessory rail 2820 to achieve separation of the rail clamp portions 2814, 2818 for removal.

Figure 21:
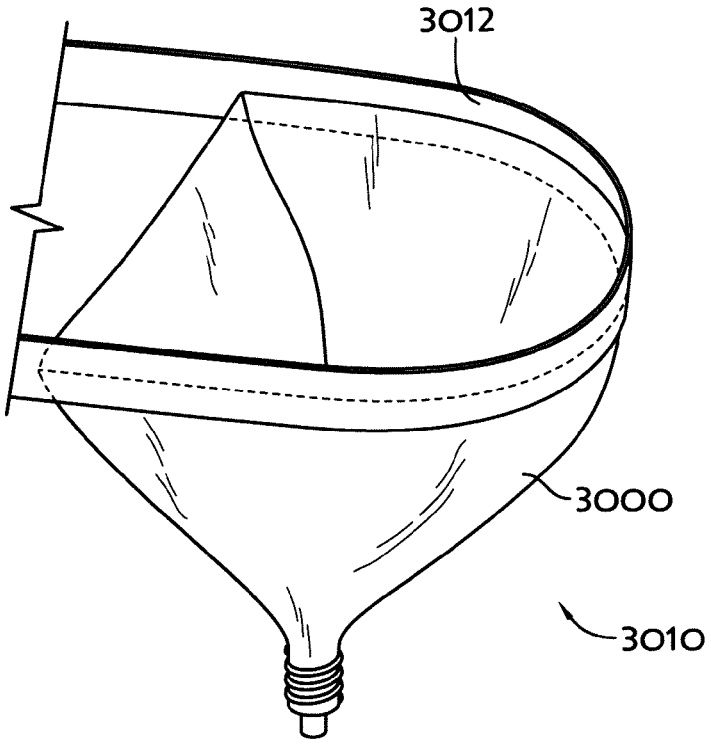
FIG. 21 is a perspective view of an embodiment in which a drainage bag is integrated with a flexible band via heat or adhesive.
Figure 22:
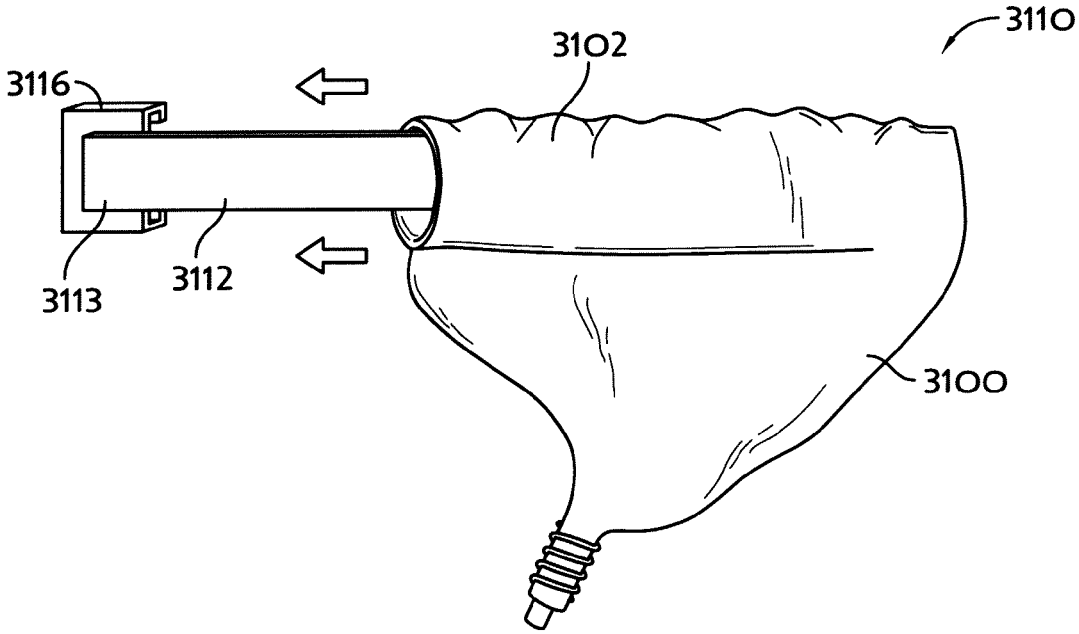
FIG. 22 is a perspective view of an embodiment in which a drainage bag is integrated with a flexible band by forming a pocket at a top region of the bag by using adhesive, heat seal, hook-and-loop type fasteners, or sewing, feeding the flexible band through the pocket, and then attaching ends of the flexible band to rail clamps.

An embodiment 3010 in which a drainage bag 3000 is integrated with a flexible band 3012 via heat (i.e., RF or sonic welding) or adhesive material (i.e., glue or cement) is shown in FIG. 21. An embodiment 3110 in which a drainage bag 3100 is integrated with a flexible band 3112 by forming a pocket 3102 at a top region of the bag by using adhesive, heat seal, hook-and-loop type fasteners, or sewing, and then feeding the flexible band 3112 through the pocket 3102 is shown in FIG. 22. To complete the integrated embodiment 3110, ends 3113 of the flexible band 3112 are attached to rail clamps 3116, only one of which is shown in FIG. 22.

Figure 23:
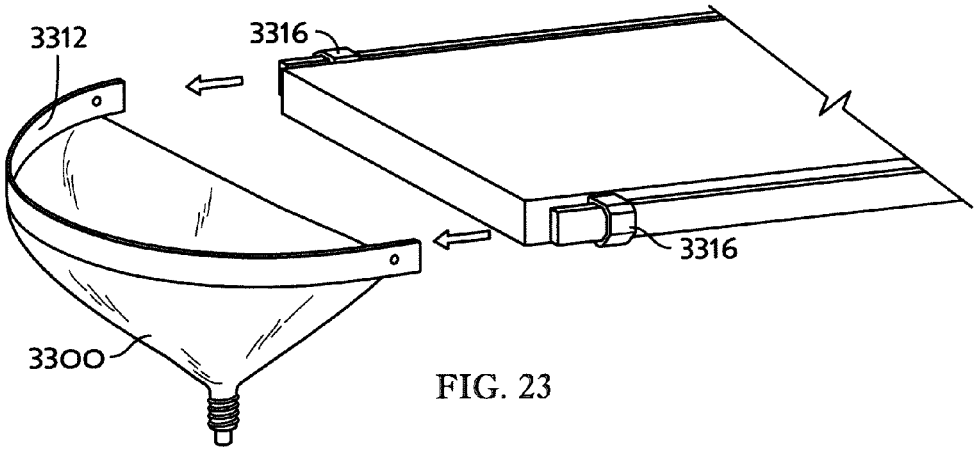
FIG. 23 is a perspective view showing an integrated bag and band combination being separated from a pair of rail clamps for disposal.

In the FIG. 23 example, an integrated bag 3300 and band 3312 combination is separated from a pair of rail clamps 3316 for disposal.

Figure 24:
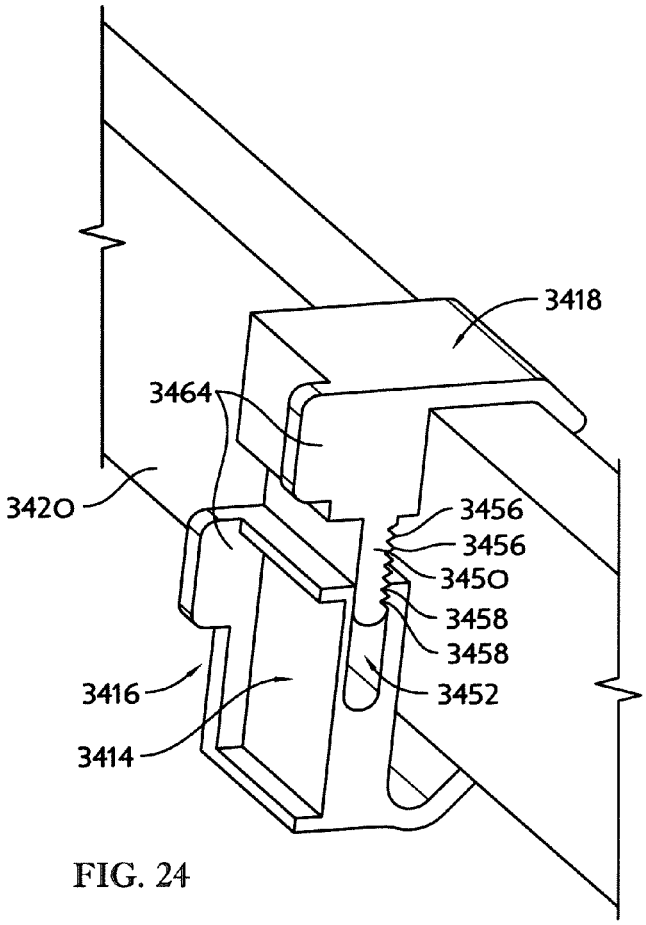
FIG. 24 is a perspective view showing an embodiment of a rail clamp having a top section with a downwardly extending toothed tab and a bottom section having a channel that accepts the toothed tab, the teeth of the toothed tab being ramped, and a pair of ramped teeth being provided at the upper end of the channel for intermeshing with the teeth of the tab.

Referring now to FIG. 24, a rail clamp 3416 has a top section 3418 with a downwardly extending toothed tab 3450 and a bottom section 3414 having a channel 3452 that accepts the toothed tab 3450. Teeth 3456 of the toothed tab 3450 are ramped. A pair of ramped teeth 3458 are provided at the upper end of the channel 3452 for intermeshing with the teeth of the tab 3450 as shown best in FIG. 24. Rail clamp 3416 is clamped onto an accessory rail 3420 by inserting the toothed tab 3450 into an upper region of the channel 3452 and then vertical squeezing portions 3414, 3418 together.

Figure 36:
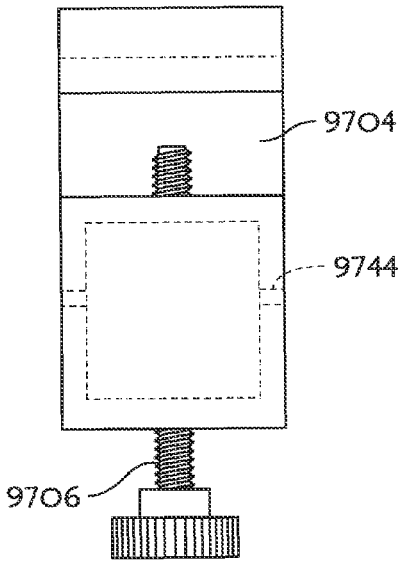
FIG. 36 is a front elevation view of the rail clamp of FIG. 32.
Figure 37:
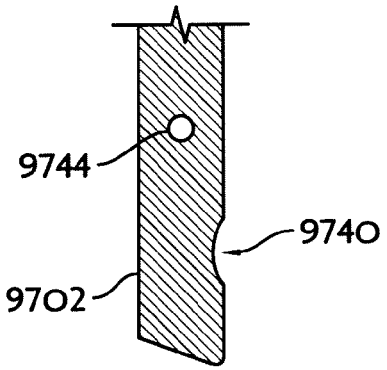
FIG. 37 is a cross-sectional view of an end region of the lever shown in FIG. 32.

After the rail clamp 3416 is completely clamped onto the accessory rail 3420, the toothed tab 3450 is fully ratcheted downwardly into the channel 3452 of the bottom section 3414 as shown in FIG. 36. To remove clamp 3416 from rail 3420, portions 3414, 3418 of clamp 3416 are slid horizontally in opposite directions along the accessory rail 3420 until portions 3414, 3418 are slid horizontally by a sufficient amount to be separated from one another. Each of portions 3414, 3418 of clamp 3416 has a finger tab 3464 that can be pressed or gripped by a user to facilitate the horizontal sliding movement of portions 3414, 3418.

Figure 25:
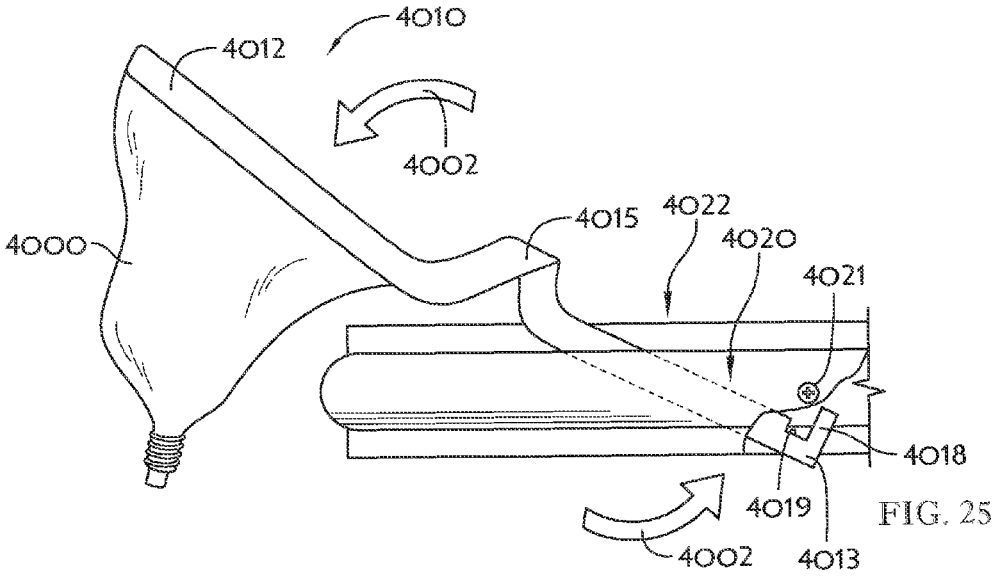
FIG. 25 is a side elevation view of a clampless integrated bag and band system showing the band and bag being rotated in the direction of counterclockwise double arrows so that ends of the band catch onto a bottom of the rail standoffs.

Referring now to FIG. 25, a clampless system 4010 includes an integrated bag 4000 and band 4012. To attach system 4010 to accessory rails 4020 of an OR table 4022, ends 4013 of band 4012 are inserted (with the bag 4000 attached) generally vertically downwardly between the OR table 4022 and the accessory rails 4020 in front of standoffs 4021 of the accessory rail 4020. Then, the band 4012 and bag 4000 are rotated in the direction of counterclockwise double arrows 4002 so that ends 4013 of the band 4012 catch onto a bottom of the rail standoffs 4021. Further rotation of the band 4012 and bag 4000 thereafter cause a looped portion 4015 of the band 4012 to rest atop the accessory rail 4020 with a majority of the flexible band 4012 being held in a horizontal orientation.

As shown in FIG. 25, an upper edge 4017 of each end portion 4013 of band 4012 has a notch 4019 that receives the rail standoff 4021 when the system 4010 is mounted to OR table 4022. A distal tab 4018 defined to the right of notch 4019 in FIG. 25 prevents system 4010 from sliding horizontally off of the accessory rails 4020 when system 4010 is in use during a surgical procedure.

Figure 26A:
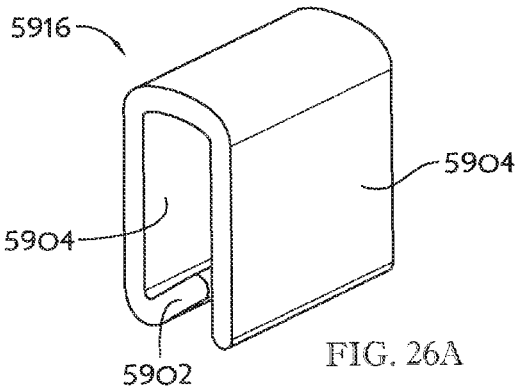
FIG. 26 has three views, labeled A-C, showing in view A, an embodiment of an upside down U-shaped rail clamp having an inclined, inwardly projecting flange extending from one of a pair of vertical walls of the rail clamp, showing in view B, the upside down U-shaped rail clamp being moved downwardly onto an accessory rail with the inclined flange contacting an upper left corner region of the accessory clamp, and showing in view C, the upside down U-shaped clamp attached to the accessory rail with the inclined flange extending beneath the accessory rail to retain the rail clamp on the accessory rail.
Figure 26B:
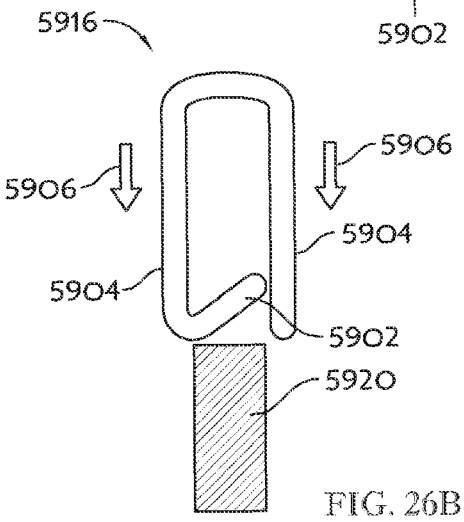
Figure 26C:
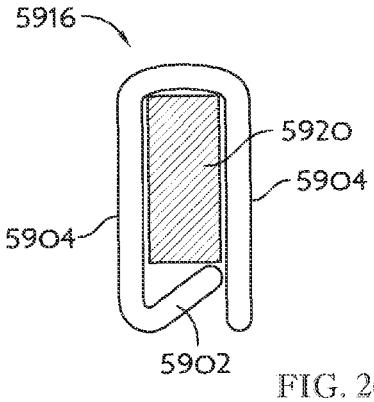

In the example of FIGS. 26A-26C, an upside down U-shaped rail clamp 5916 has an inclined, inwardly projecting flange 5902 extending from one of a pair of vertical walls 5904 of the rail clamp. As clamp 5916 is moved downwardly in the direction of arrows 5906 onto an accessory rail 5920, the inclined flange 5902 first contacts an upper left corner region of the accessory clamp 5920 (see FIG. 26B). Further downward movement of clamp 5916 over accessory rail 5920 causes flange 5902 and the associated wall 5904 to flex outwardly. When clamp 5916 is fully inserted downwardly onto the accessory rail 5930, the inclined flange 5902 extends beneath the accessory rail 5920 to retain the rail clamp 5916 on the accessory rail 5920.

Figure 27:
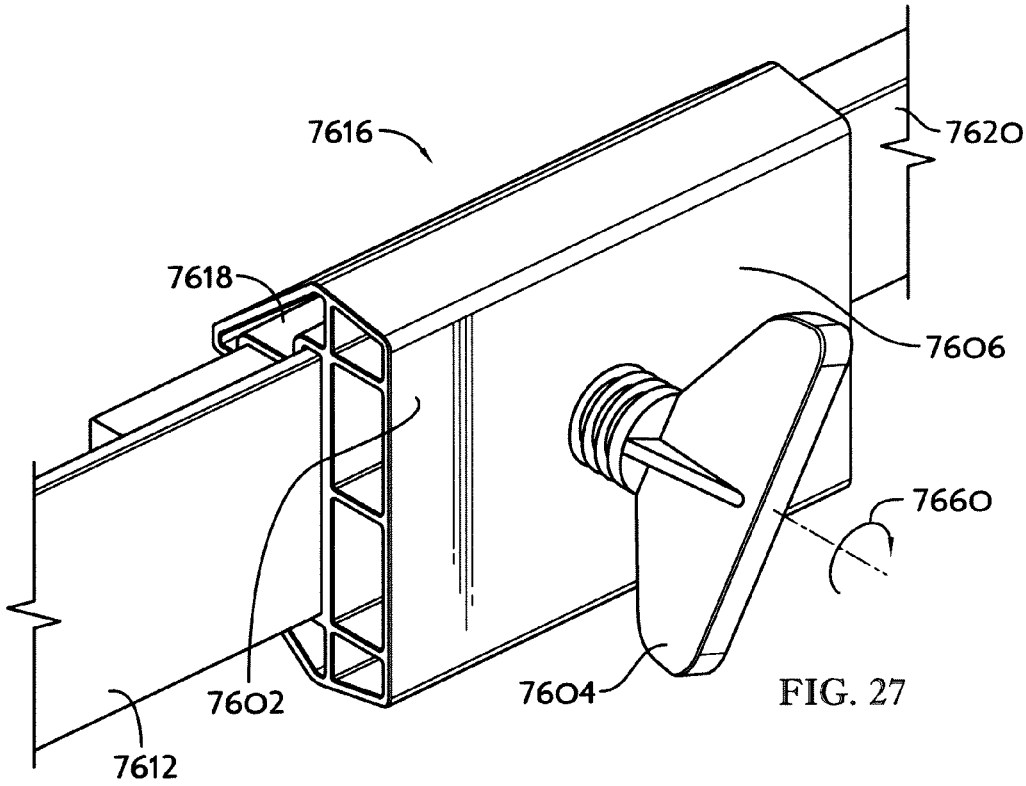
FIG. 27 is a perspective view showing an embodiment of a rail clamp having a molded clamp body that slips onto an end of an accessory rail and having a threaded knob that threads through a vertical wall of the clamp body and that projects through a hole in a flexible band to engage a vertical surface of an accessory rail to mount the rail clamp and the flexible band to the accessory rail.
Figure 28:
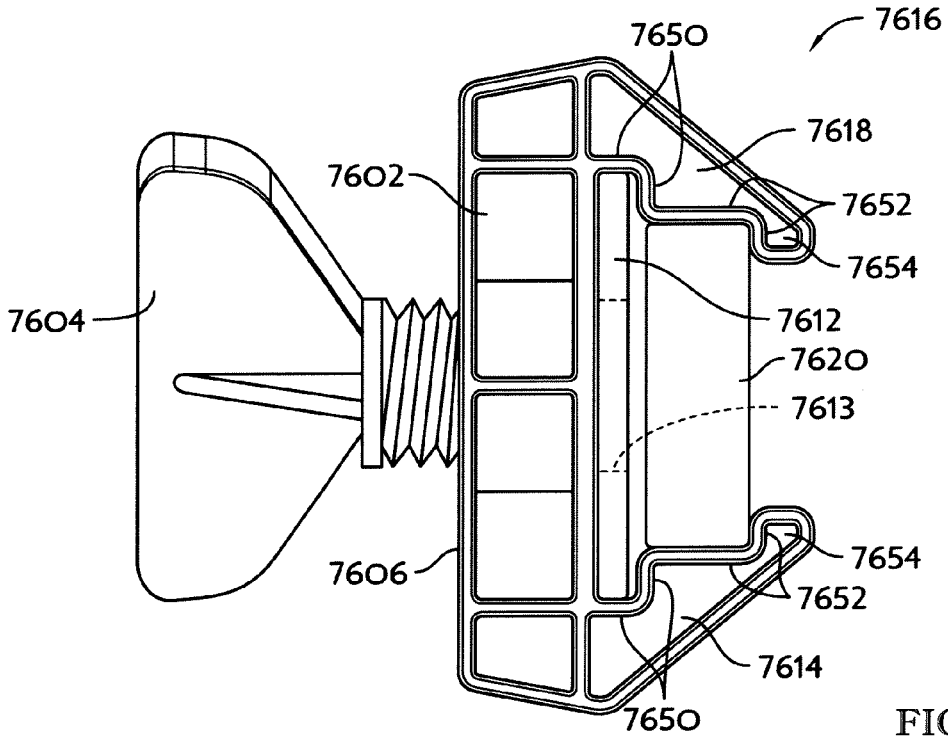
FIG. 28 is an end elevation view of the embodiment of FIG. 27 showing the clamp body having stepped upper and lower jaws with a first set of upper and lower shoulders defining upper and lower band receiving grooves adjacent the vertical wall of the clamp body, a second set of upper and lower shoulders defining rail receiving channels that receive the accessory rail, and retention tips adjacent portions of a vertical surface of the accessory rail.

Referring now to FIGS. 27 and 28, a rail clamp 7616 has a molded clamp body 7602 that slips onto an end of an accessory rail 7620 and has a threaded knob 7604 that threads through a vertical wall 7606 of the clamp body 7602. The tip of threaded knob 7604 projects through a hole 7613 (shown in FIG. 28 in phantom) in a flexible band 7612 to engage a vertical surface of an accessory rail 7620 to mount the rail clamp 7616 and the flexible band 7612 to the accessory rail 7620. Clamp body 7602 has stepped lower and upper jaws 7614, 7618 with a first set of upper and lower shoulders 7650 (see FIG. 28) defining upper and lower band receiving grooves adjacent the vertical wall 7606 of the clamp body 7602 and a second set of upper and lower shoulders 7652 (see FIG. 28) defining rail receiving channels that receive the accessory rail 7620. Retention tips 7654 are defined adjacent shoulders 7654. Tips 7654 are adjacent a vertical surface of the accessory rail 7620.

A drainage bag (not shown) couples to flexible band 7612. Rail clamp 7616 is attached to an accessory rail 7620 of an OR table (not shown). Rail clamps 7616 and flexible band 7612 are attached to accessory rails 7620 of an OR table (not shown) and arrows 7660 show the rotational direction of tightening the threaded knobs 7604 so that knob 7604 is turned away from the user to secure the rail clamps 7616 to the rails 7620. To accomplish this, the patient's left clamp 7616 has a clockwise thread and the patient's right clamp 7616 as a counterclockwise thread.

Figure 29:
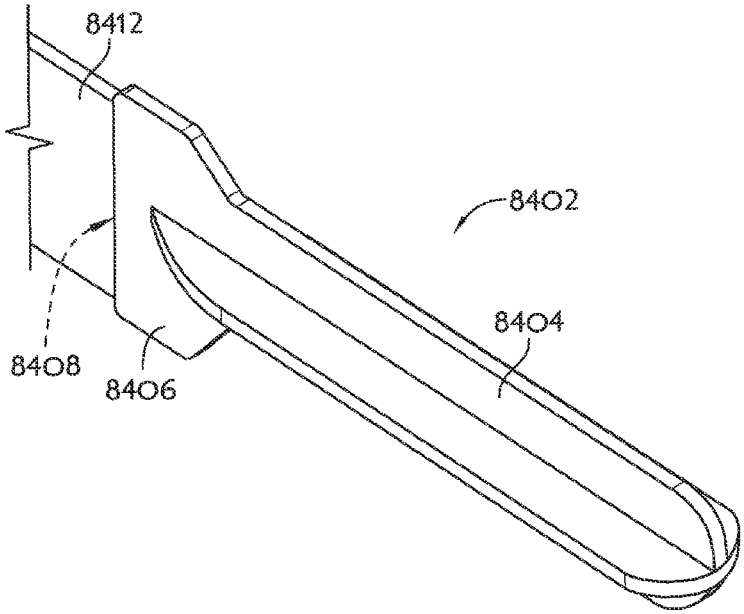
FIG. 29 is an isometric view of a plastic coupler having an elongated post of X-shaped or cross-shaped cross section and a rectangular band receiving portion at the end of the elongated post showing a flexible band attached to the rectangular band receiving portion.
Figure 30:
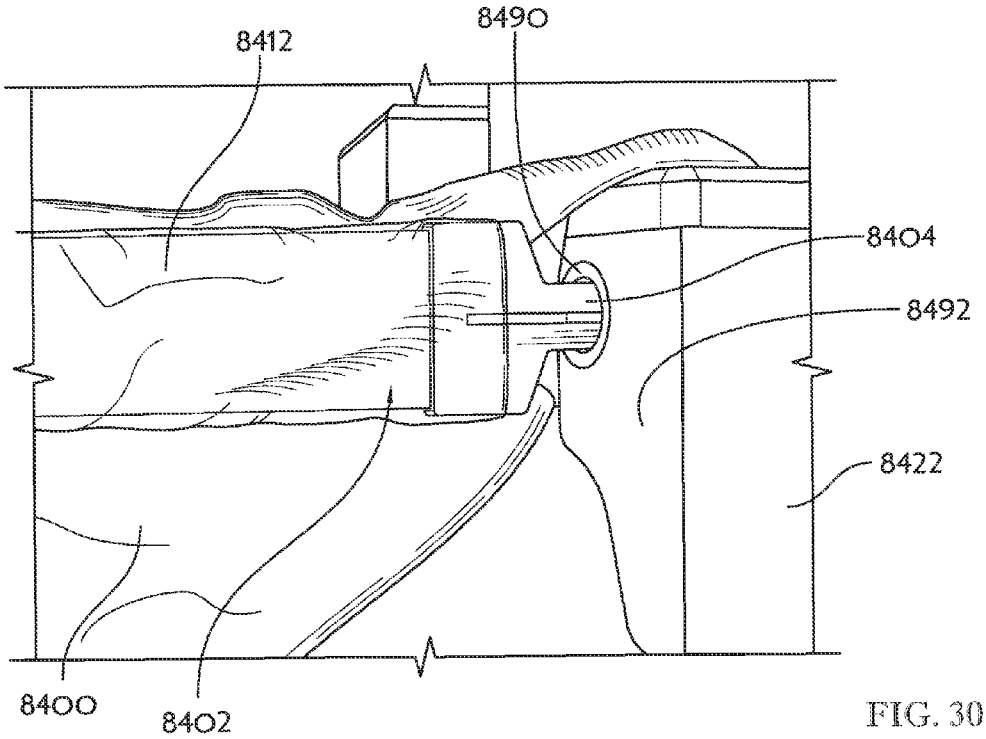
FIG. 30 is a detailed perspective view of the plastic coupler of FIG. 29 showing a urology drainage bag attached to the flexible band that has its ends attached to respective plastic couplers and showing the post of the plastic coupler inserted into a horizontal socket provided in a frame member of an OR table.

Referring now to FIGS. 29 and 30, a plastic coupler 8402 has an elongated post 8404 of X-shaped or cross-shaped cross section and a rectangular band receiving portion 8406 at the end of the elongated post 8404. A flexible band attached to the rectangular band receiving portion 8406 via a press fit into a cavity 8408 of portion 8406. A urology drainage bag 8400 attaches to the flexible band 8412 that has its ends attached to respective plastic couplers 8402. The post 8404 of the plastic coupler 8402 is sized for press fit insertion into a horizontal socket 8490 provided in a frame member 8492 of an OR table 8422 as shown best in FIG. 30.

Figure 31:
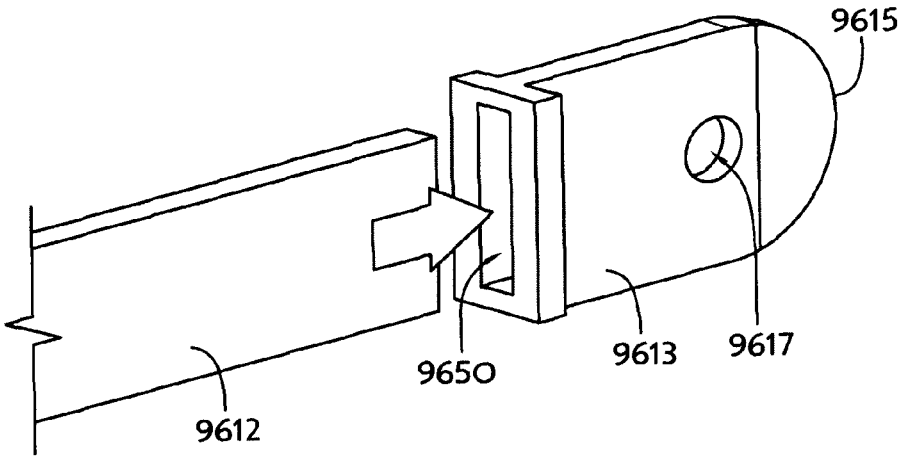
FIG. 31 is a perspective view of a flexible band having a tip that is molded to include a rounded end and a through hole and that attaches to the main band member with heat or adhesive.
Figure 32:
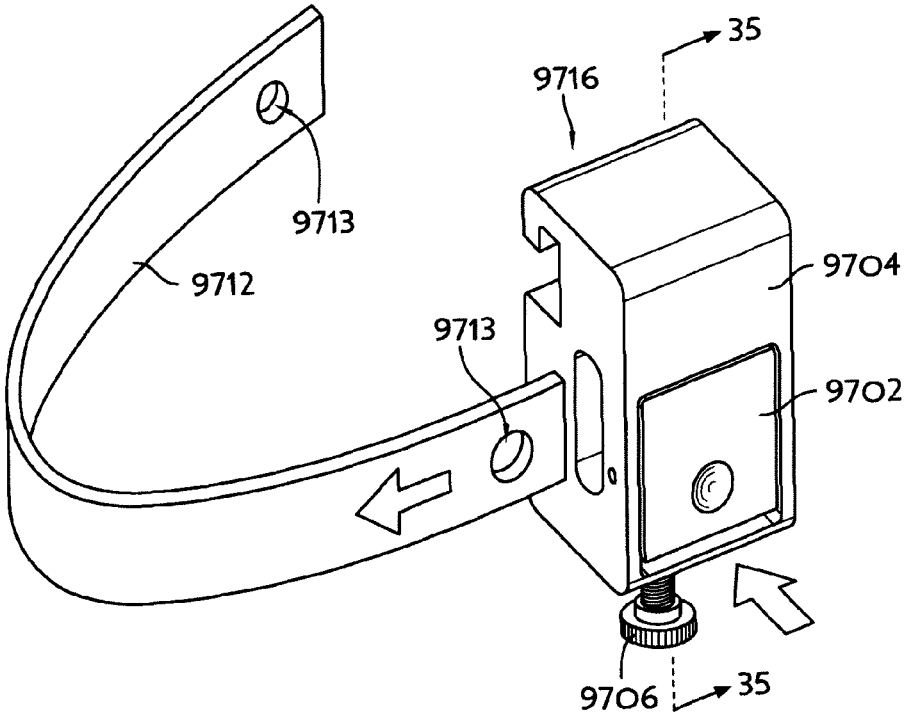
FIG. 32 is a perspective view of a reusable rail clamp having a lever that can be pushed to permit the flexible band to be detached from the rail clamp.
Figure 33:
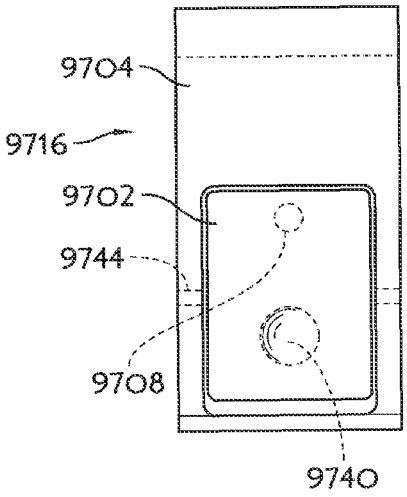
FIG. 33 is a rear elevation view of the rail clamp of FIG. 32.
Figure 34:
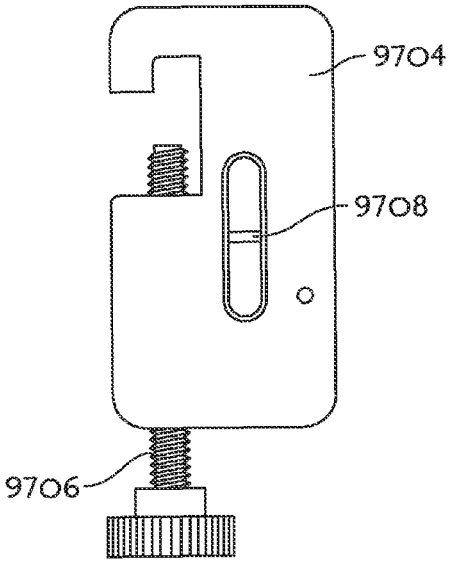
FIG. 34 is a side elevation view of the rail clamp of FIG. 32.

In the FIG. 31 example, a flexible band 9612 has separate tips 9613 that are molded to include a rounded end 9615 and a through hole 9617. Tips 9613 have band receiving pockets 9650 sized to receive the main band member with a press fit. In alternative embodiments, heat or adhesive is used to couple the main band member to tips 9613.

Figure 35:
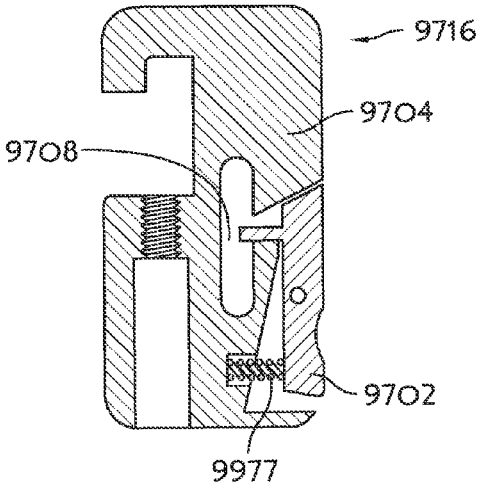
FIG. 35 is a cross-sectional view of the rail clamp of FIG. 32 taken at line 35-35 as shown in FIG. 32 showing the reusable rail clamp body having a spring loaded pivotable lever with a projecting pin at its upper end that is received in the through hole of a flexible band to retain the flexible band in place relative to the rail clamp body.
Figure 38:
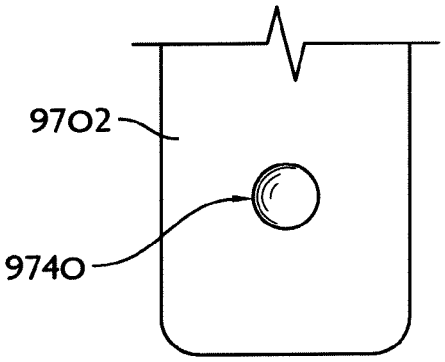
FIG. 38 is a rear elevation view of the end region of FIG. 37.
Figure 39:
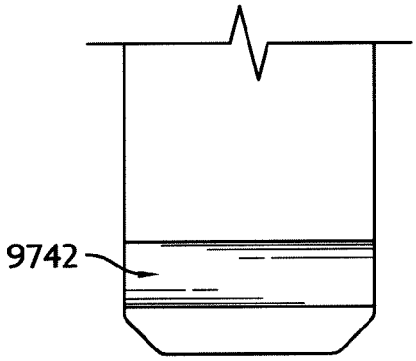
FIG. 39 is a rear elevation view of an alternative end region of the lever shown in FIG. 32 wherein the lever includes a channel extending across the lower end of the lever.

Referring now to FIGS. 32-36, a reusable rail clamp 9716 has a lever 9702 attached to a main clamp body 9704. Lever 9702 can be pushed to permit a flexible band 9712 to be detached from the rail clamp 9716. Clamp 9716 has a vertically oriented threaded knob 9706 that can be tightened against the bottom of an accessory rail (not shown) to retain clamp 9716 on the rail. Lever 9702 has a protrusion 9708 (see FIG. 35) that is received in a hole 9713 of band 9712 to retain band 9712 relative to main body 9704 of clamp 9716. Lever 9702 can have a pocket 9740 (see FIG. 38) or channel 9742 (see FIG. 39) to indicate where a user should push on lever 9702 to pivot the lever 9702 about a pin 9744. FIG. 35 shows cross sections of reusable rail 9716 with clamp body 9704 having a spring 9977 biasing pivotable lever 9702 to a locking position in which a projecting pin 9708 at its upper end is received in the through hole 9713 of flexible band 9712 to retain the flexible band 9712 in place relative to the rail clamp body 9704.

Although certain illustrative embodiments have been described in detail above, many embodiments, variations and modifications are possible that are still within the scope and spirit of this disclosure as described herein and as defined in the following claims.

The invention claimed is:

1. A drainage bag system configured to be coupled to a surgical table having accessory rails, the drainage bag system comprising a drainage bag, a band coupled to and supporting the drainage bag, and a rail clamp including an upper jaw configured to engage the accessory rail of the surgical table and a slot sized to receive the band, wherein the rail clamp also includes a protrusion extending into the slot.

2. The drainage bag system of claim 1, wherein the band is formed to include a hole extending through the band and configured to receive the protrusion when the band is received in a predetermined position in the slot.

3. The drainage bag system of claim 2, wherein the clamp includes a lever and the protrusion extends out from the lever, the lever being movable between a locked position wherein the protrusion extends through the band blocking the band from being removed from the slot and a released position wherein the protrusion is moved out of the slot so that the band can be removed from the slot.

4. The drainage bag system of claim 1, wherein the clamp includes a lower platform formed to include a threaded hole and a threaded knob engaging the threaded hole.

5. The drainage bag system of claim 4, wherein the lower platform, the upper jaw, and the protrusion form a monolithic clamp body.

6. The drainage bag system of claim 4, wherein the clamp also includes a lower jaw movable relative to the upper jaw to clamp the accessory rail between the upper jaw and the lower jaw.

7. The drainage bag system of claim 6, wherein the lower jaw pivots about a jaw axis to move between the open and the closed position.

8. The drainage bag system of claim 6, wherein the lower jaw is moved between the open position and the closed position by the threaded knob.

9. The drainage bag system of claim 8, wherein the upper jaw, the lower platform, and the lower jaw cooperate to form a monolithic clamp body.

10. The drainage bag system of claim 9, wherein the clamp body is formed from a plastics material.

11. The drainage bag system of claim 1, wherein the band is engaged by the protrusion when the band is received in a predetermined position in the slot to resist removal of the band from the slot.

12. The drainage bag system of claim 11, wherein the clamp includes a lever mounted to move relative to the slot and the protrusion extends out from the lever, the lever being movable between a locked position wherein the protrusion engages the band resisting removal of the band from the slot and a released position wherein the protrusion disengages the band freeing the band to be removed from the slot.

13. A drainage bag system configured to be coupled to a surgical table having accessory rails, the drainage bag system comprising a drainage bag, a band coupled to and supporting the drainage bag, and a rail clamp including an upper jaw configured to engage the accessory rail of the surgical table and a slot sized to receive the band, wherein the clamp includes a lower platform formed to include a threaded hole and a threaded knob engaging the threaded hole, the clamp also includes a lower jaw movable relative to the upper jaw to clamp the accessory rail between the upper jaw and the lower jaw, and the lower jaw pivots about a jaw axis defined by a living hinge to move between the open and the closed position.

14. A drainage bag system configured to be coupled to a surgical table having accessory rails, the drainage bag system comprising a drainage bag, a band coupled to and supporting the drainage bag, and a rail clamp including an upper jaw configured to engage the accessory rail of the surgical table and a slot sized to receive the band, wherein the rail clamp includes a lower jaw spaced apart from the upper jaw and configured to engage the accessory rail of the surgical table and the lower jaw is movable about a jaw axis formed by a living hinge from an open position to a closed position.

15. The drainage bag system of claim 14, wherein the clamp includes a knob configured to retain the lower jaw in the closed position.

16. The drainage bag system of claim 15, wherein the knob is configured to move the lower jaw about the jaw axis from the open position to the closed position.

17. The drainage bag system of claim 15, wherein the clamp includes a lower platform formed to include a threaded hole and the knob includes threads that engage the threaded hole.

18. The drainage bag system of claim 14, wherein the rail clamp includes a protrusion extending into the slot.

19. The drainage bag system of claim 18, wherein the band is engaged by the protrusion when the band is received in a predetermined position in the slot to resist removal of the band from the slot.

20. The drainage bag system of claim 19, wherein the clamp includes a lever mounted to move relative to the slot and the protrusion extends out from the lever, the lever being movable between a locked position wherein the protrusion engages the band resisting removal of the band from the slot and a released position wherein the protrusion disengages the band freeing the band to be removed from the slot.

* * * * *